US006421521B2

(12) United States Patent
Tanaka

(10) Patent No.: US 6,421,521 B2
(45) Date of Patent: Jul. 16, 2002

(54) IMAGE FORMING APPARATUS FORMING AN IMAGE BY TRANSFERRING EACH OF THE PLURALITY OF IMAGES FORMED BY A PLURALITY OF IMAGE FORMING DEVICES ONTO A TRANSFER MEDIUM BY MEANS OF TRANSFER MEMBERS

(75) Inventor: Yasuo Tanaka, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/799,488

(22) Filed: Mar. 7, 2001

(30) Foreign Application Priority Data

Mar. 14, 2000 (JP) ..... 2000-069846

(51) Int. Cl.[7] ..... G03G 15/01; G03G 15/16
(52) U.S. Cl. ..... 399/299; 399/66; 399/302
(58) Field of Search ..... 399/298, 299, 399/300, 302, 314, 66, 88

(56) References Cited

U.S. PATENT DOCUMENTS 5,187,536 A 2/1993 Hasegawa et al. ..... 399/300
5,765,082 A 6/1998 Numazu et al. ..... 399/299
5,854,958 A 12/1998 Tanimoto et al. ..... 399/49
5,943,526 A 8/1999 Kodama ..... 399/66
5,978,615 A 11/1999 Tanaka et al. ..... 399/49
6,134,402 A * 10/2000 Nakayama et al. ..... 399/299 X
6,134,415 A * 10/2000 Iwakura et al. ..... 399/299
6,314,264 B1 * 11/2001 Iida et al. ..... 399/302

FOREIGN PATENT DOCUMENTS

JP 6-110343 4/1994
JP 9-50197 2/1997

* cited by examiner

*Primary Examiner*—Sophia S. Chen
(74) *Attorney, Agent, or Firm*—Morrison & Foerster, LLP

(57) ABSTRACT

An image forming apparatus includes four photosensitive drums provided in a line along the transport path of a recording sheet, four transfer rollers respectively provided in positions opposite to the photosensitive drums, via the transport path. When voltages are applied to the transfer rollers, each of them generates an electric field for transferring a toner image formed on the surface of the corresponding photosensitive drum onto the recording sheet. A constant voltage power supply, and a voltage distributing circuit by which an outputted voltage as it is from the constant voltage power supply is applied to one of the transfer rollers, while different voltages are applied to the remaining three transfer rollers by dividing the outputted voltage by means of three zener diodes.

30 Claims, 17 Drawing Sheets

IMAGE FORMING APPARATUS FORMING AN IMAGE BY TRANSFERRING EACH OF THE PLURALITY OF IMAGES FORMED BY A PLURALITY OF IMAGE FORMING DEVICES ONTO A TRANSFER MEDIUM BY MEANS OF TRANSFER MEMBERS

This application is based on an application No. 2000-69846 filed in Japan, the content of which is hereby incorporated by reference.

BACKGROUND OF THE INVENTION (1) Field of the Invention

The present invention relates to an image forming apparatus, such as a copier and a printer, and particularly relates to a transfer technique used by an image forming apparatus in which an image is formed by transferring images formed using a plurality of image forming devices onto a transfer medium at different positions.

(2) Description of the Related Art

In these days, so-called tandem-type copiers are becoming increasingly common, which comprises a plurality of image forming devices image-forming toner images with different reproduced colors of cyan(C), magenta(M), yellow (Y), and black(K) are provided in a line along the travelling direction of the transfer belt.

As an example of such a tandem-type copier, Japanese Laid-Open Patent Application No. 6-110343 teaches the following apparatus (the first prior art).

FIG. 1 is a schematic diagram showing a construction of an image forming section of a tandem-type copier in the first prior art. As shown in FIG. 1, this tandem-type copier comprises a plurality of image forming devices 110C to 110K forming toner images with colors of C, M, Y, and K and provided in a line along the travelling direction of a transport belt 121, and a plurality of transfer rollers 125C to 125K for serving as transfer members provided in the positions opposite to photosensitive drums 111C to 111K of image forming devices 110C to 110K via the transport belt 121, respectively. Constant voltage power supplies 170C to 170K are connected to the transfer rollers 125C to 125K, respectively. As a recording sheet S is transported by the transport belt 121, images with differently developed colors are superimposed to form a color image by applying transfer voltages to the transfer rollers 125C to 125K sequentially.

Here, the transfer voltage applied to each of the transfer rollers 125C to 125K is set so that a voltage across the transfer roller at the lower stream is higher than the upper stream. That is, the transfer voltage is increased gradually higher according to the arranged order of the transfer rollers. The transport belt and the recording sheet become charged in the former transfer step and then transported to the next transfer position with being charged. In addition, the thickness of toner on the recording sheet is increased as the transfer step goes to the lower stream. Consequently, unless a higher voltage is applied to the transfer roller in the lower stream, the same transfer efficiency cannot be maintained on the recording sheet.

Therefore, in the first prior art, the transfer rollers 125C to 125K have constant voltage power supplies 170C to 170K respectively, where voltages are set so as to increase gradually as the transfer step goes to the lower stream, whereby the stability of transfer efficiency of the toner image with each color can be obtained.

In the above first prior art, however, a plurality of constant voltage power supplies are required as many as the number of the transfer rollers, so that an increase in the cost of the tandem-type copier and upsizing thereof are inevitable.

In order to solve the above stated problem, Japanese Laid-Open Patent Application No. 9-50197 discloses another tandem-type copier (the second prior art). FIG. 2 is a schematic view showing a construction of an image forming section of a tandem-type copier in the second prior art. Each of transfer rollers 180C to 180K is connected in parallel to a constant voltage power supply 171, so that the same voltage is applied to each of the transfer rollers. The resistance value of each of the transfer rollers 180C to 180K is set so as to decrease gradually as the transfer step goes to the lower stream. Normally, a transfer roller is made up of a core metal covered with an electrically conductive rubber, whose resistance value can be varied by adjusting a quantity of carbon to be mixed therewith.

Thereby, even if the same voltage is applied to each of the transfer rollers 180C to 180K, a transfer current passing through the corresponding photosensitive drum among 111C to 111K can be increased gradually as the transfer step goes to the lower stream. Therefore, an effect of stabilization of the transfer efficiency can be achieved with one constant voltage power supply. In addition, a reduction of costs and downsizing for the tandem-type copier can be realized.

In the above second prior art, however, four kinds of transfer rollers 180C to 180K whose resistance value is different from each other have to be prepared. Consequently, there is a problem that a manufacturing cost is increased as compared with the copier using one type of transfer rollers.

Moreover, it is very difficult, in fact, to adjust the subtle resistance value of each electrically conductive roller, so that the manufacturing process has to be controlled precisely. In addition, granted that proper resistance values can be obtained, there is a problem that the proper ratio of each resistance value of the transfer rollers cannot be maintained for a long time, because the degree of the change in the resistance values may vary with each other due to the difference in the contents of carbon.

The problems stated above may occur in a like manner when electrically conductive transfer blades or the like are adopted as transfer members instead of the transfer rollers.

SUMMARY OF THE INVENTION

The object of the present invention is to provide an image forming apparatus wherein an appropriate voltage can be applied to each transfer member while low-cost and downsizing of the apparatus can be realized with a compact structure.

The above object of the present invention can be achieved by an image forming apparatus made up of: a plurality of image forming devices; a plurality of transfer members which are provided in one-to-one correspondence with the image forming devices, and sequentially transfer images formed by the image forming devices onto a transfer medium; a transfer power supply device which generates a predetermined voltage for a transfer operation; and a voltage distributing circuit which is arranged between the transfer power supply device and each of the transfer members; and distributes different voltages to one-to-one correspondence with the transfer members.

The above object of the present invention can be also achieved by an image forming apparatus made up of: at least three image forming devices; a plurality of transfer members which are provided in one-to-one correspondence with the image forming devices, and sequentially transfer images formed by the image forming devices onto a transfer medium; a plurality of transfer power supply devices which generates predetermined voltages for transfer operations, a number of the transfer power supply devices is one less than a number of the transfer members; and a voltage distributing circuit which is arranged between two or more transfer members and a first transfer power supply device among the transfer power supply devices and distributes different voltages to one-to-one correspondence with two or more transfer members.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes an image forming apparatus according to preferred embodiments of the present invention, with reference to the drawings.

(First Embodiment)

Figure 1:
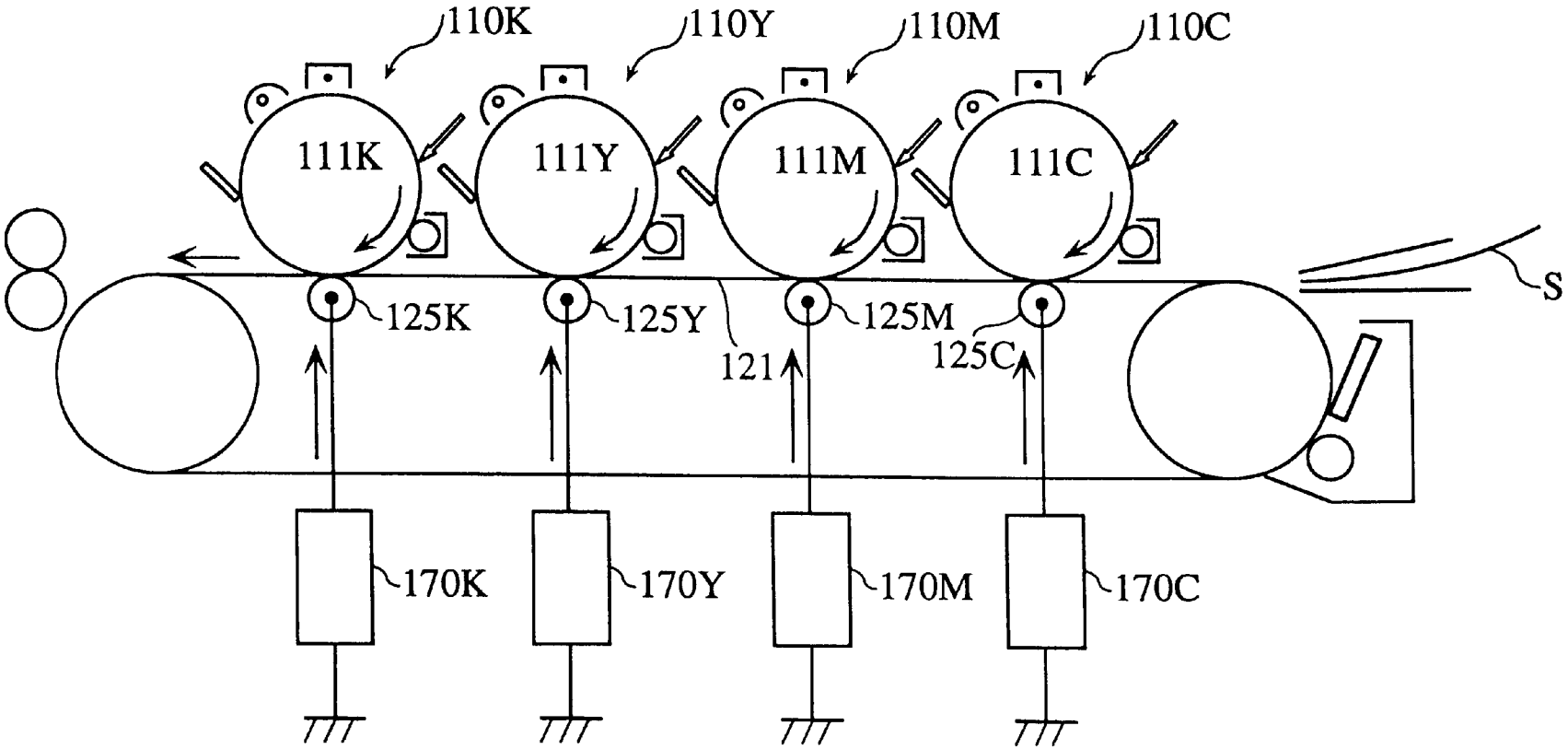
FIG.1 PRIOR ART
FIG. 1 shows an image forming section of a tandem-type copier in the first prior art.
Figure 2:
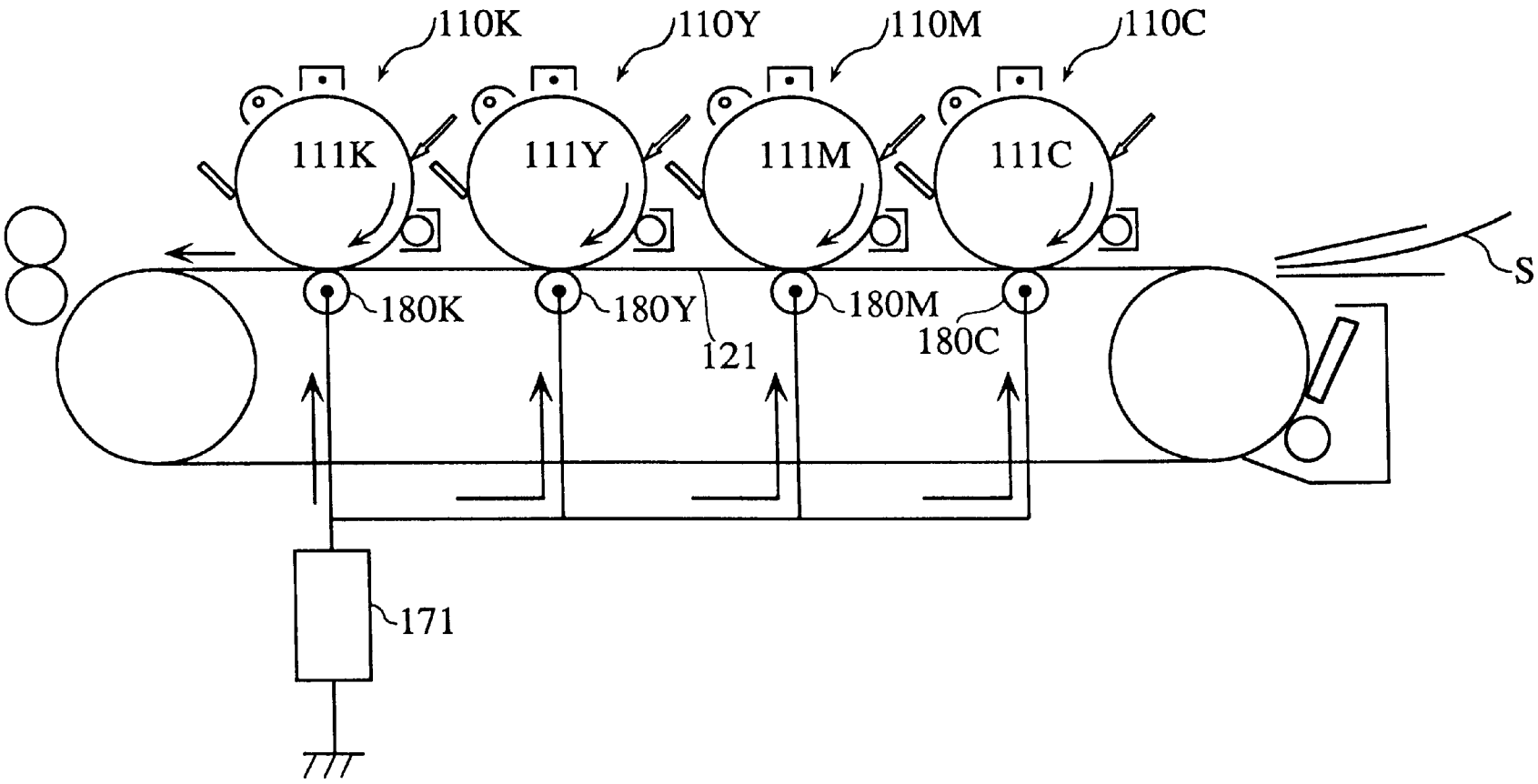
FIG.2 PRIOR ART
FIG. 2 shows an image forming section of a tandem-type copier in the second prior art.
Figure 3:
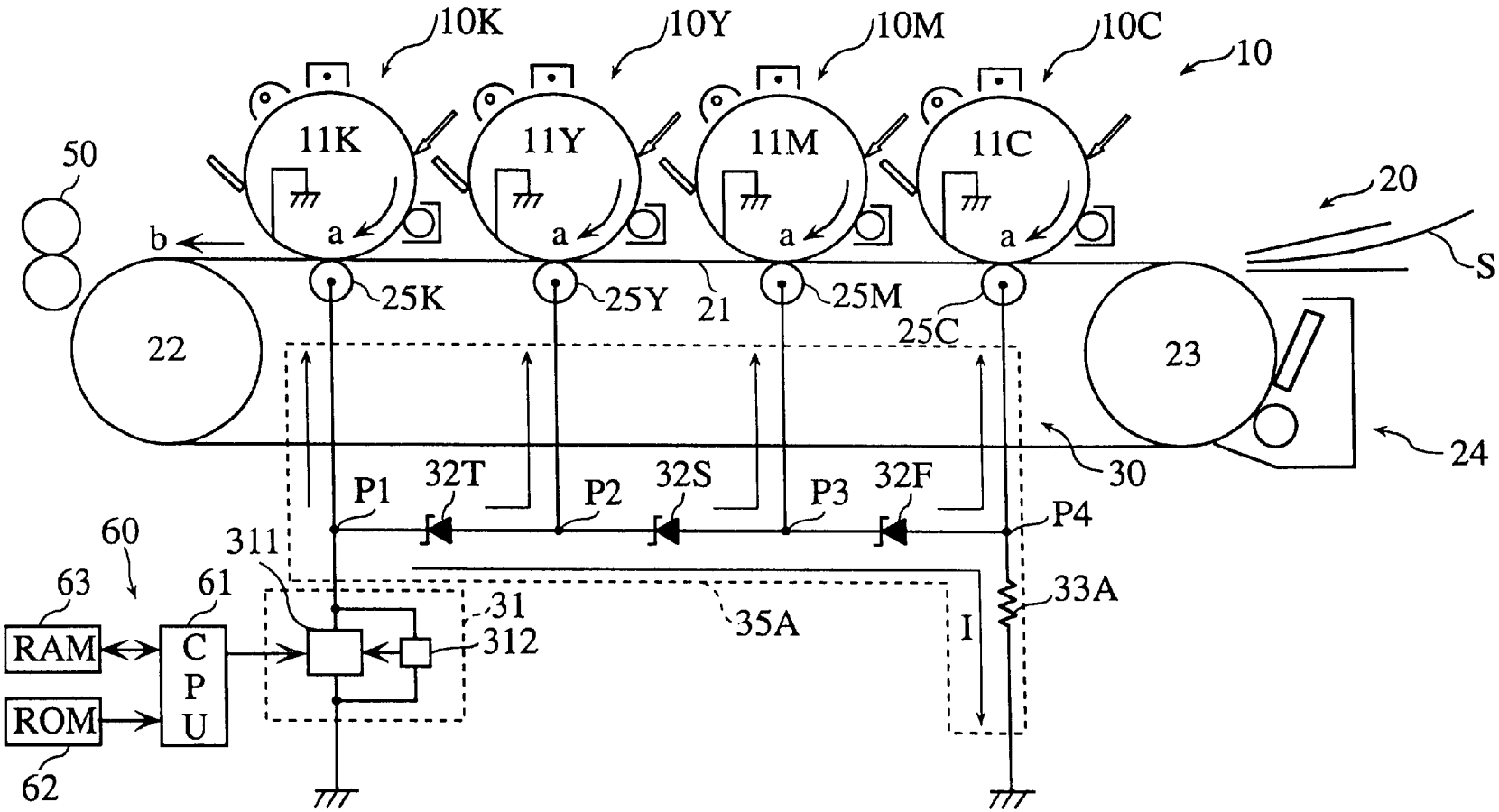
FIG. 3 shows an image forming section of a tandem-type copier according to the first embodiment of the present invention.

FIG. 3 is a schematic view showing the construction of an image forming section of a tandem-type copier according to the first embodiment of the present invention. As shown in FIG. 3, the image forming section comprises an image forming unit 10, a sheet transport unit 20, a transfer unit 30, a fixing unit 50, and a control unit 60.

The image forming unit 10 is provided with image forming devices 10C to 10K forming toner images of cyan(C), magenta(M), yellow(Y), and black(K). Each of the image forming devices 10C to 10K has a well-known configuration where a cleaner, charger, a developing unit, and so on are provided on the periphery of each of the photosensitive drums 11C to 11K as each center.

Each of the photosensitive drums 11C to 11K is charged with the charger and exposed with light-modulated laser beams according to each image data, while rotating in the direction of the arrow a. By means of this exposure, electrostatic latent images are respectively formed on the surface of each of the photosensitive drums 11C to 11K and then visibly developed by receiving corresponding toner of each color to be reproduced from each developing unit.

The sheet transport unit 20 is configured so that a transport belt 21 is kept tight by a driving roller 22 and a slave roller 23 and the driver roller 22 is rotationally driven at a predetermined speed by a driving mechanism (not shown), whereby a recording sheet S is transported on the transport surface of the transport belt 21 in the direction of the arrow b.

The transport belt 21 is an electrically conducting seamless belt whose thickness, surface resistance value, and volume resistance value are 100 $\mu$m, approximately $10^{12}$ $\Omega/cm^2$, and $10^{10}$ $\Omega\cdot cm$, respectively. For example, this is made by dispersing a predetermined quantity of carbon into thermosetting polyimide resin, and then pouring the same into a metal mold to be molded through the following imidization reactions.

A belt cleaner 24 is provided in a position opposite to the slave roller 23 via the transport belt 21 and removes toner particles on the surface of the transport belt 21 in order to keep the same clean.

The transfer unit 30 consists of a plurality of transfer rollers 25C to 25K, a voltage distributing circuit 35A, and a constant voltage power supply 31.

Each of the transfer rollers 25C to 25k is provided immediately below the corresponding photosensitive drum 11C to 11K via the transport belt 21. These four rollers are electrically conductive rollers of the same material. For example, an elastic roller made up of a core metal covered with electrically conductive rubber in which a predetermined quantity of carbon is dispersed is adopted. The hardness and resistance value of this roller are 60 degree and $3\times10^6\Omega$, respectively according to the Japanese Industrial Standards-A (JIS-A).

A voltage generated at the constant voltage power supply 31 is applied to each of the transfer rollers 25C to 25K via the voltage distributing circuit 35A. By means of an electric field generated by the voltage, each of the toner images formed on the photosensitive drums 11C to 11K is sequentially transferred onto the recording sheet S. The recording sheet S on which a plurality of toner images are superimposed is transported to the fixing unit 50 by way of the transport belt 21, where the toner image is fixed. Finally, the recording sheet S is discharged onto a discharge tray (not shown).

The voltage distributing circuit 35A comprises a plurality of zener diodes 32F to 32T for serving as voltage drop elements, a fixed resistor 33A, and so on.

The zener diodes 32F to 32T are connected in series with each other. One end (P1) of the zener diode 32T is connected to an output side of the constant voltage power supply 31, while one end (P4) of the zener diode 32F is grounded via the fixed resistor 33A. Meanwhile, the transfer rollers 25K to 25C are connected to the points P1 to P4 of zener diodes 32F to 32T respectively, which are connected in series.

A transfer voltage to be applied to each transfer roller (hereafter called an optimum transfer voltage) is different in each apparatus, but can be easily obtained through experiments or the like. In a preferred embodiment of the present invention, optimum transfer voltages of transfer rollers 25C to 25K are set to be 900V, 1,200V, 1,500V, and 1,800V, respectively. Therefore, zener diodes whose zener voltage is 300V are used for the zener diodes 32F to 32T. Thus, the voltage distributing circuit 35A divides an voltage from the constant voltage power supply 31, so that voltages (1,500V, 1,200V, and 900V) can be obtained by deducting the zener voltage sequentially from the outputted voltage. Here, the resistance value of the fixed resistor 33A is 1MΩ.

These zener diodes have an advantage of relatively low-cost, as compared with the manufacturing cost of electrically conductive rollers having different resistance values. Besides, the zener voltage is stable, and their life is semi-permanent. Thus, employing these zener diodes leads to reduction of the cost of the apparatus and maintaining of the appropriate transfer voltages.

The constant voltage power supply 31 comprises a constant voltage control unit 311 and a voltage detecting unit 312 detecting the voltage generated at the power unit. The constant voltage control unit 311 including a voltage generating part controls a voltage generated at the voltage generating unit so as to be always equal to a standard voltage (1,800V in a preferred embodiment of the present invention) specified by a control unit 60 (described later) by comparing the both voltages, and outputs the controlled voltage.

The control unit 60 transmits a set of information, such as a start-up instruction and a standard voltage, to the constant voltage power supply 31, while controls the operation of each unit so as to carry out a smooth image forming operation. This unit includes a CPU 61, a ROM 62, and a RAM 63. The ROM 62 stores a control program to carry out the image forming operation, the standard voltage used for constant voltage control of the constant voltage power supply 31, and so on. The RAM 63 temporarily stores a variety of control variables and the like, while providing a working area during execution of the program.

Here, the fixed resistor 33A is connected in order to secure a current operating the zener diodes 32F to 32T. That is, a current passing through each of the photosensitive drums 11C to 11K via the transport belt 21 from each of the transfer rollers 25C to 25K is approximately 5 to 50 μA, which is relatively small as compared with the current range where the zener diodes can operate properly. Therefore, the zener diodes are grounded via the fixed resistor 33A, so that the current passing through each zener diode can be within their operating current range. Assuming that a current is increased by I due to the above circuit configuration, I becomes 900 μA (=900V/1MΩ), because a resistance value of the fixed resistor 33A is 1MΩ and a voltage at P4 is 900V. This current (I=900 μA) is within the operating current range where the zener diodes can operate properly, so that stable transfer voltages can be applied to each of the transfer rollers 25C to 25K. Although the fixed resistor 33A whose resistance value is 1 MΩ is used in this embodiment, another appropriate fixed resistor may be selected according to the specification for used zener diodes.

By means of the above described structure, a predetermined optimum transfer voltage can be applied to each of the transfer rollers, while using a plurality of transfer rollers with the same specification. Therefore, there is no need to use a plurality of transfer rollers whose resistance value is different from each other as in the second prior art described above, which leads to reduction of the manufacturing cost of the transfer rollers and maintaining of a semipermanently stable voltage ratio of each of the plurality of photosensitive drums.

(Modifications in the First Embodiment)

The following modifications may apply to the first embodiment of the present invention.

(1) In the above stated first embodiment, the zener diodes 32F to 32T are used for applying predetermined voltages to each of the transfer rollers. However, fixed resistors may replace these zener diodes.

Figure 4:
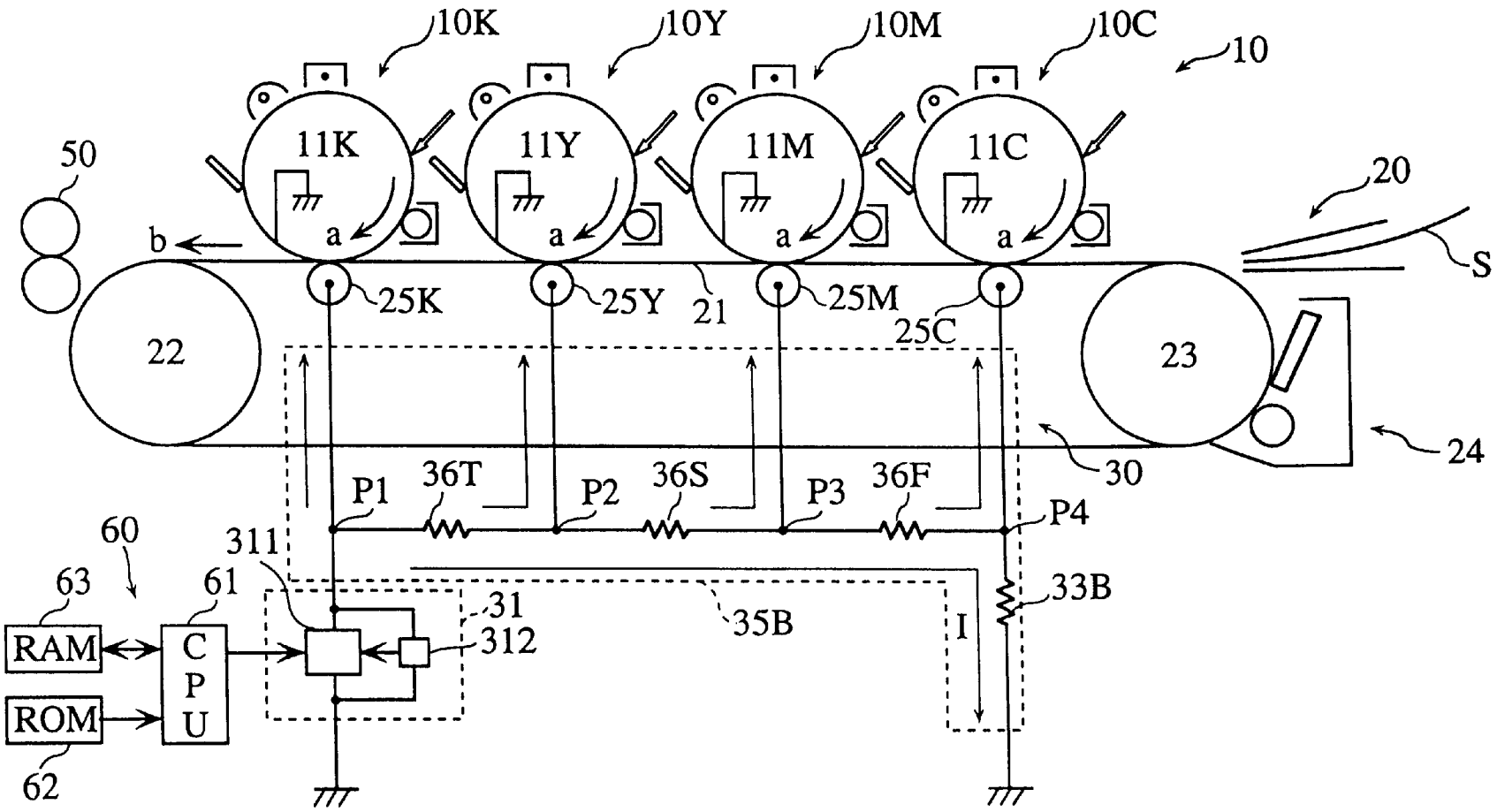
FIG. 4 shows an image forming section of a tandem-type copier wherein fixed resistors replace the zener diodes in FIG. 3.

FIG. 4 shows an image forming section in which a voltage distributing circuit 35B is configured so that fixed resistors 36F to 36T replace the zener diodes 32F to 32T in FIG. 3.

A fixed resistor whose resistance value is 330 kΩ is used for each of the fixed resistor 36F to 36T, while a fixed resistor whose resistance value is 990 kΩ is used for a fixed resistor 33B. By means of the above configuration, optimum transfer voltages of 900V, 1,200V, 1,500V, and 1,800V are applied to transfer rollers 25C to 25K respectively in the same way as the above first embodiment.

Alternatively, varistors may be used in place of the zener diodes, which have similar electric characteristics.

(2) Films or blades made of electrically conductive resin or electrically conductive rubber, or brushes or rotating brushes made of electrically conductive fibers may apply to the first embodiment in place of transfer rollers for serving as transfer members.

Figure 5:
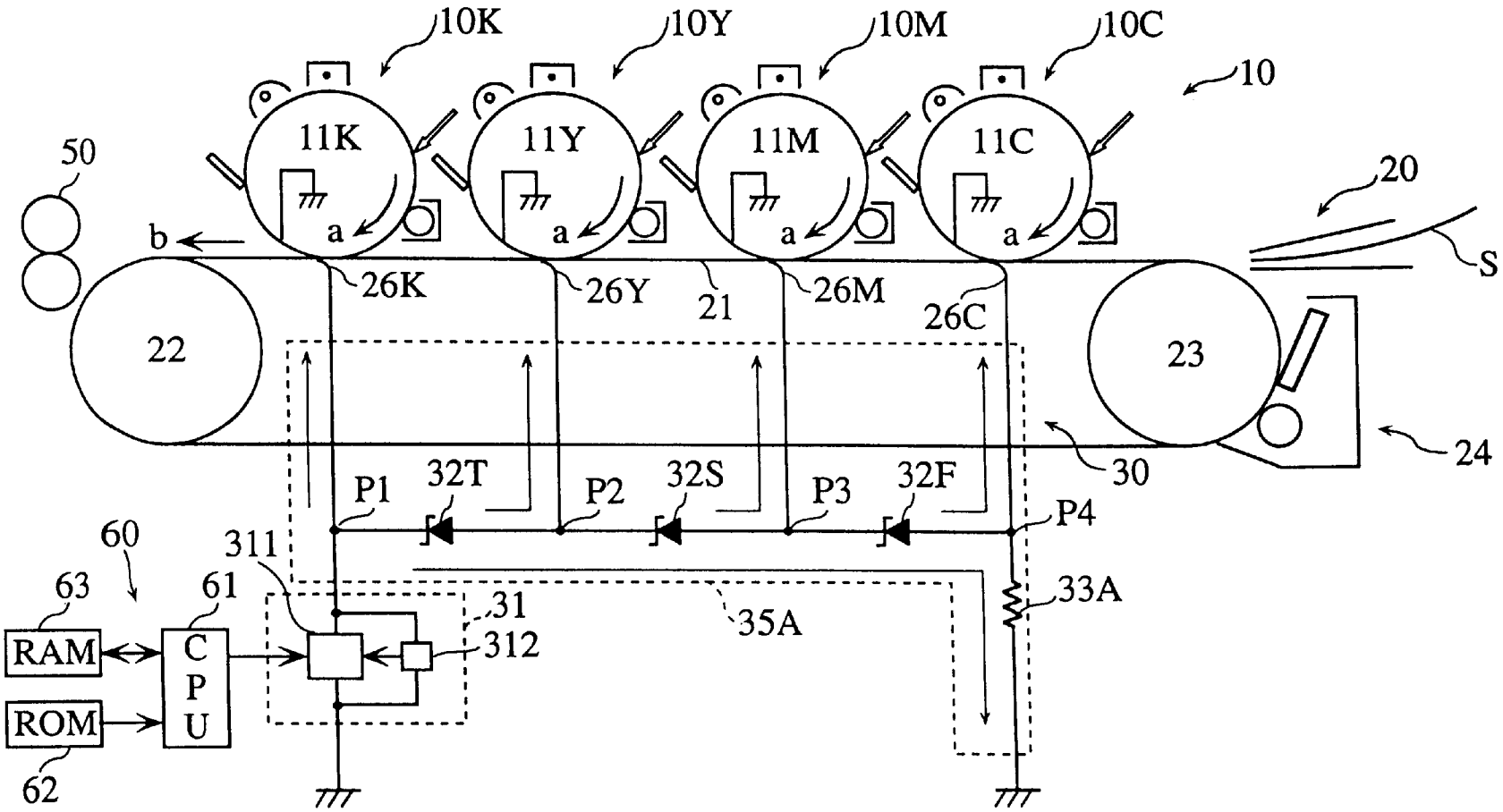
FIG. 5 shows an image forming section of a tandem-type copier wherein transfer films replace the transfer rollers in FIG. 3.

FIG. 5 shows an example in case that transfer films 26C to 26K replace the transfer rollers 25C to 25K in FIG. 3. The transfer films 26C to 26K have almost the same width as the transport belt 21, and their positions and gradients are adjusted so that each of them contacts with the transport belt 21 with an adequate contact pressure. A material whose electrical conductivity is the same level as the transfer rollers is used for the transfer films.

Figure 6:
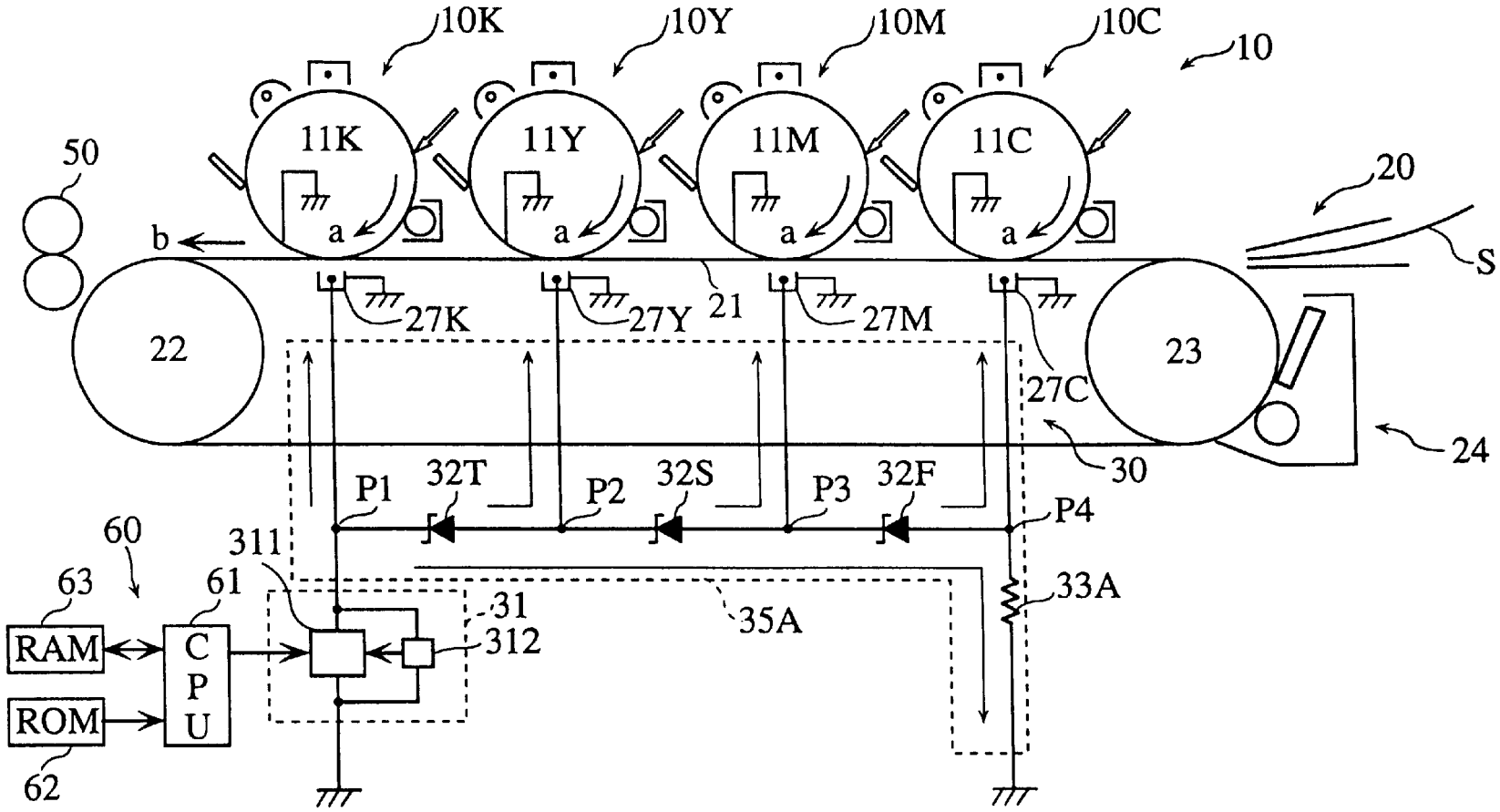
FIG. 6 shows an image forming section of a tandem-type copier wherein corona dischargers replace the transfer rollers in FIG. 3.

(3) Alternatively, non-contact corona dischargers may be used as the transfer members as shown in FIG. 6. Corona dischargers with the same specification are used for each of the corona dischargers 27C to 27K.

(4) Otherwise, two constant voltage power supplies may be provided for monochrome image forming and color image forming.

Figure 7:
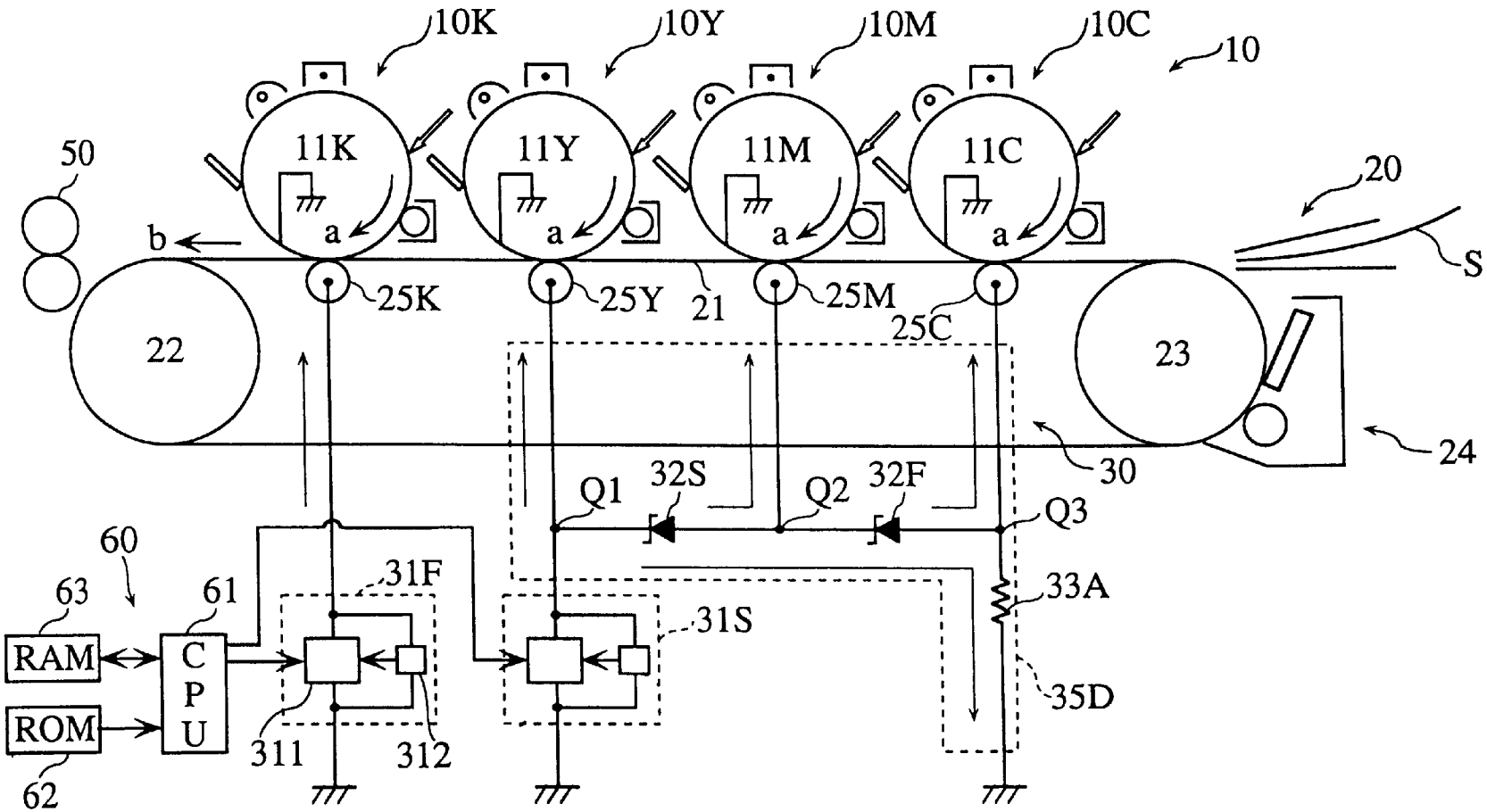
FIG. 7 shows an image forming section of a tandem-type copier wherein two constant voltage power supplies are used in the first embodiment of the present invention.

FIG. 7 shows a construction of a transfer unit 30 wherein two constant voltage power supplies are used.

A constant voltage power supply 31F used for transfer of a black toner to form monochrome images is connected so as to apply to the transfer roller 25K only. In this case, the applied voltage becomes 1,800V, which equals the optimum transfer voltage for the transfer roller 25K.

A voltage generated at a constant voltage power supply 31S for transfer of color toners to form color images is controlled so as to be equal to the optimum transfer voltage for the transfer roller 25Y (=1,500V).

A voltage distributing circuit 35D includes zener diodes 32S and 32F whose zener voltage is 300V and are connected in series with each other. One end Q3 of the zener diodes 32S and 32F connected in series is grounded via the fixed resistor 33A, while the other end Q1 is connected to the constant voltage power supply 31S.

Then, the transfer roller 25Y, 25M, and 25C are connected to the Q1, Q2 at the midpoint between the zener diodes 32S and 32F, and Q3, respectively, so that voltages of 1,500V, 1,200V, and 900V are applied to transfer rollers 25Y, 25M, and 25C, respectively.

Even in this case, the number of power supplies can be reduced when compared with the first prior art. In addition, there is no need to use a plurality of transfer rollers whose resistance value is different from each other, whereby stable transfer voltages can be obtained when compared with the second prior art.

(5) So far, a direct transfer method was described, in which toners are transferred from photosensitive drums onto a recording sheet. The first embodiment of the present invention, however, can apply to so-called intermediate transfer method in which after toners are transferred from photosensitive drums onto a transfer belt (a first transfer operation), then the same are transferred again from the transfer belt onto a recording sheet (a secondary transfer operation).

Figure 8:
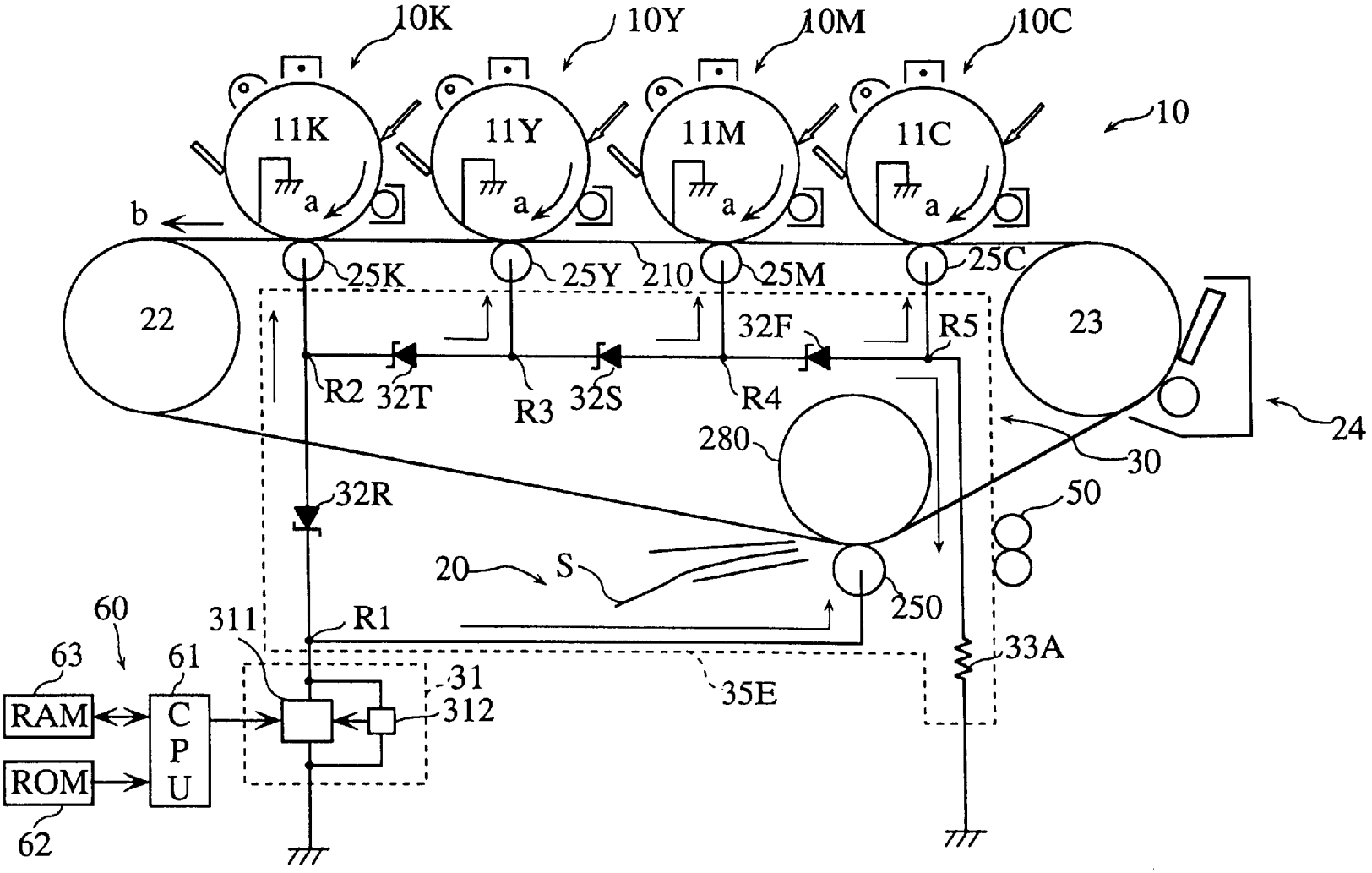
FIG. 8 shows an image forming section showing an example in case that the present invention applies to a tandem-type copier in an intermediate transfer method.

FIG. 8 shows a schematic construction of a tandem-type image forming section in the intermediate transfer method.

As shown in FIG. 8, the image forming section is configured so that a transfer belt 210 is kept tight by a drive roller 22, a slave roller 23, and a backup roller 280, and a secondary transfer roller 250 is provided for serving as transfer members in a position opposite to the backup roller 280 via the transfer belt 210, in addition to transfer rollers 25C to 25K used for a first transfer.

A voltage distributing circuit 35E is configured so that a zener diode 32R is connected in series and prior to the zener diode 32T, in addition to the zener diodes 32F, 32S, and 32T stated above. Applying a voltage to R1 by the constant voltage power supply 21, voltages at the R1, R2 to R5 are applied to the secondary transfer roller 250, and transfer rollers 25K, 25Y, 25M, and 25C, respectively. In this case, a CPU 61 controls the constant voltage power supply 31 so as to generate a secondary transfer voltage of 2,100V.

By means of above described construction, adequate transfer voltages can be applied to all transfer rollers including the secondary transfer roller with only one power supply device.

(6) Three zener diodes are used for applying different voltages to all four transfer rollers in the above described embodiment. However, for example, only the zener diode 32F may be used, so that a lower voltage than transfer rollers 25M to 25K is only applied to the transfer roller 25C, while different voltages may be applied to the other transfer rollers using the first or second prior art. Even in this construction, though the transfer efficiency may go down, the manufacturing cost of the transfer rollers can be reduced.

(Second Embodiment)

The following describes a tandem-type copier according to the second embodiment of the present invention.

Figure 9:
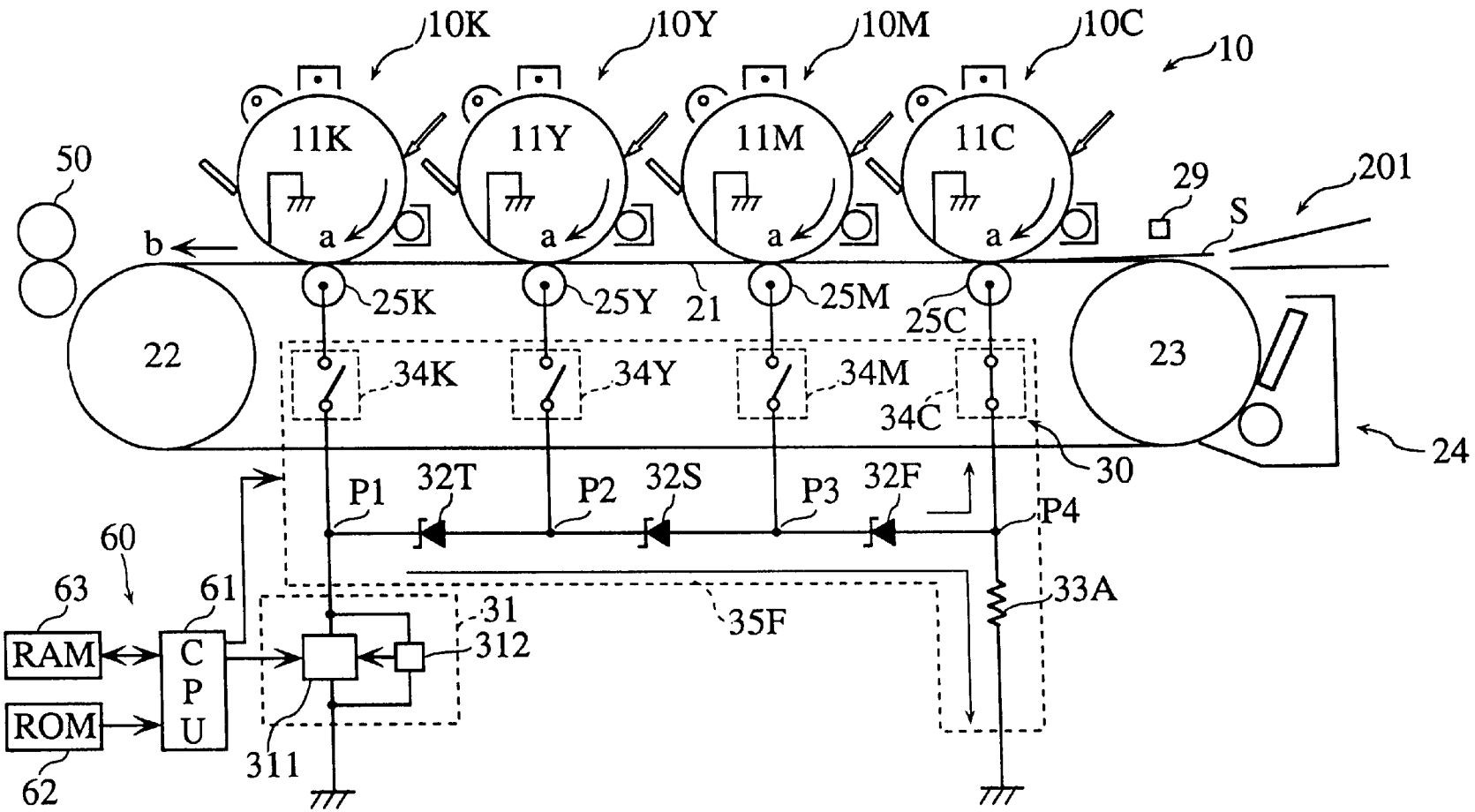
FIG. 9 shows an image forming section of a tandem-type copier according to the second embodiment of the present invention.

FIG. 9 shows a schematic construction of an image forming section of a tandem-type copier according to a second embodiment. An image forming section shown in FIG. 9 is the same as in FIG. 3, except that a sheet transport unit, a voltage distributing circuit, and so on are different from those in FIG. 3. Therefore, elements other than the elements assigned the same numbers as in FIG. 3 will be mainly described.

In a sheet transport unit 201, a reflection type photoelectronic sensor 29 is provided immediately before the photosensitive drum 11C in order to detect a transported recording sheet, which detects passing of the front and rear ends of the recording sheet S transported on the transport belt 21.

Meanwhile, in a voltage distributing circuit 35F, switch units 34C to 34K are provided between points P1 to P4 and transfer rollers 25C to 25K respectively, so that each path can be disconnected. Electromagnetic relays, for example, are used for the switch units 34C to 34K, where the CPU 61 controls the relays so that they are turned ON only when the recording sheet S is passing through the corresponding transfer position.

That is, the timing when the front end of the recording sheet is arriving at each transfer position or when the rear end of the recording sheet is passing through each transfer position can be easily obtained by counting the time after the front or rear end of the recording sheet S is detected. This is because the distance between the reflection type photoelectronic sensor 29 and each transfer position, and the traveling speed of the transport belt 21 are known in advance. Therefore, the CPU 61 can judge which transfer position the recording sheet is passing through and control so that the only switch unit corresponding to the transfer position is turned ON.

The construction stated above can avoid the deterioration of the characteristics of photosensitive drums by stopping the application of a voltage to the transfer rollers which are not functioning.

More specifically, if a voltage is always applied to the transfer roller so as to charge the corresponding photosensitive drum, the charge characteristics of the photosensitive material will deteriorate and the potential absolute value on the surface of the photosensitive drum will decrease during an image forming. As a result of that, the image density will change and the reproducibility will degrade. Meanwhile, the resistance characteristics of the transfer roller tend to change by applying power for a long time. Therefore, in this respect also, it is preferable to shorten the time to apply a voltage as possible.

Then, if each switch unit is turned ON only during the transfer operation as described above, the photosensitive characteristics of the photosensitive drums and the resistance characteristics of the transfer roller will not deteriorate unnecessarily, so that their lives will be increased.

(Third Embodiment)

The following describes the third embodiment of a tandem-type copier according to the present invention.

Figure 10:
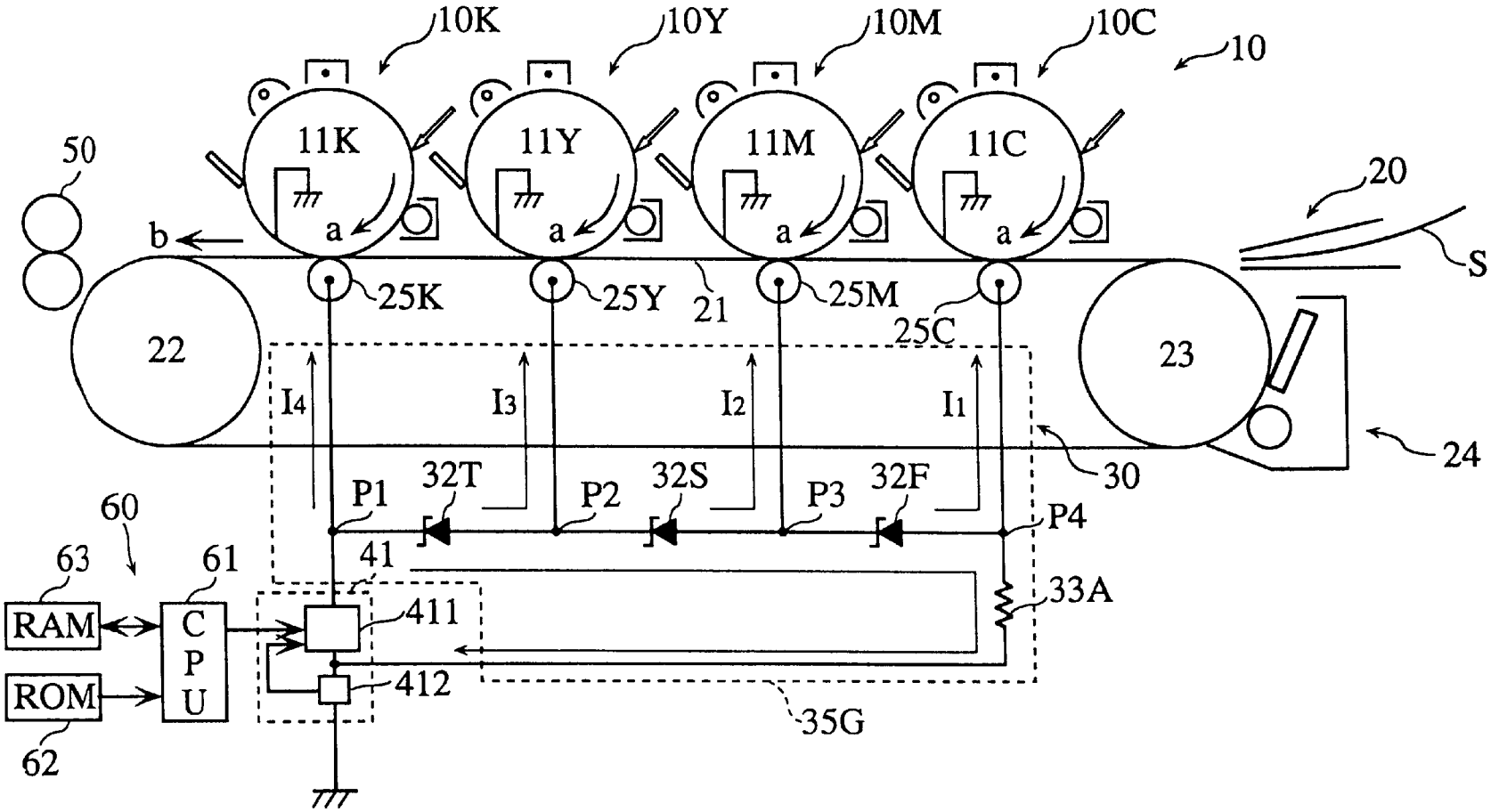
FIG. 10 shows an image forming section of a tandem-type copier according to the third embodiment of the present invention.

FIG. 10 shows an image forming section of a tandem-type copier according to the third embodiment of the present invention. A major feature of the image forming section shown in FIG. 10 is that a transfer power supply is controlled by the constant current method. The construction of the image forming section in FIG. 10 is basically the same as in FIG. 3, except that a constant current power supply 41 is used for the power supply device. Therefore, elements other than the elements assigned the same numbers as in FIG. 3 will be mainly described.

In FIG. 10, the constant current power supply 41 consists of a constant current control unit 411 and a current detector 412. The current detector 412 detects a total current value passing through each of the transfer rollers. The constant current control unit 411 controls the total current passing through each of the transfer rollers so as to be equal to a predetermined current and supplies the controlled current to a voltage distributing circuit 35G stated as follows.

The construction of the voltage distributing circuit 35G is the same as in FIG. 3 in that the zener diodes 32F to 32T and the fixed resistor 33A are connected in series, but different in that one end of the fixed resistor 33A opposite to the other end connected to the zener diode 32F is connected to the constant current control unit 411, not via the current detector 412. Therefore, a current that the current detector 412 detects is a current passing through an earthed circuit, i.e., which becomes equal to a total sum of transfer currents I1 to I4 passing from each of the transfer rollers 25C to 25K to each of the photosensitive drums 11C to 11K.

Then, if the constant current control unit 411 is feedback controlled so that this total sum of transfer currents I1 to I4 (i.e., I1+I2+I3+I4) becomes an optimum current, this total transfer current can be controlled into a fixed optimum value with reliability. This optimum current is different in each apparatus, but can be easily determined in advance through experiments or the like.

Here, this third embodiment is the same as the first embodiment in that the resistance value of the fixed resistor 33A is determined so that the current passing through each of the zener diodes 32F to 32T is within the operating current range where the zener diodes can operate properly.

Thereby, even if the resistance value of the transfer current path through each transfer roller and each photosensitive drum varies due to a change in the resistance value of each transfer roller over time or surrounding conditions, such as temperature and humidity, a fixed total transfer current can be maintained.

Here, each of the transfer rollers 25C to 25K is made of the same material, so that their deterioration or influence of surrounding conditions can be estimated to be at the same level. As such, if only the total transfer current is controlled to be a fixed value, the transfer currents I1 to I4 passing through the transfer rollers respectively also can be considered to be controlled. Consequently, a stable transfer efficiency can be secured at each transfer roller and an excellent quality of images can be obtained for a long time.

(Modifications in the Third Embodiment)

The following modifications may apply to the above third embodiment.

(1) The above stated third embodiment is configured so that the voltage distributing circuit 35G is always connected to each of the transfer rollers. However, a plurality of switch units may be provided between paths immediately before transfer roller so that these switches are electrically disconnected during the period other than the transfer operation.

Figure 11:
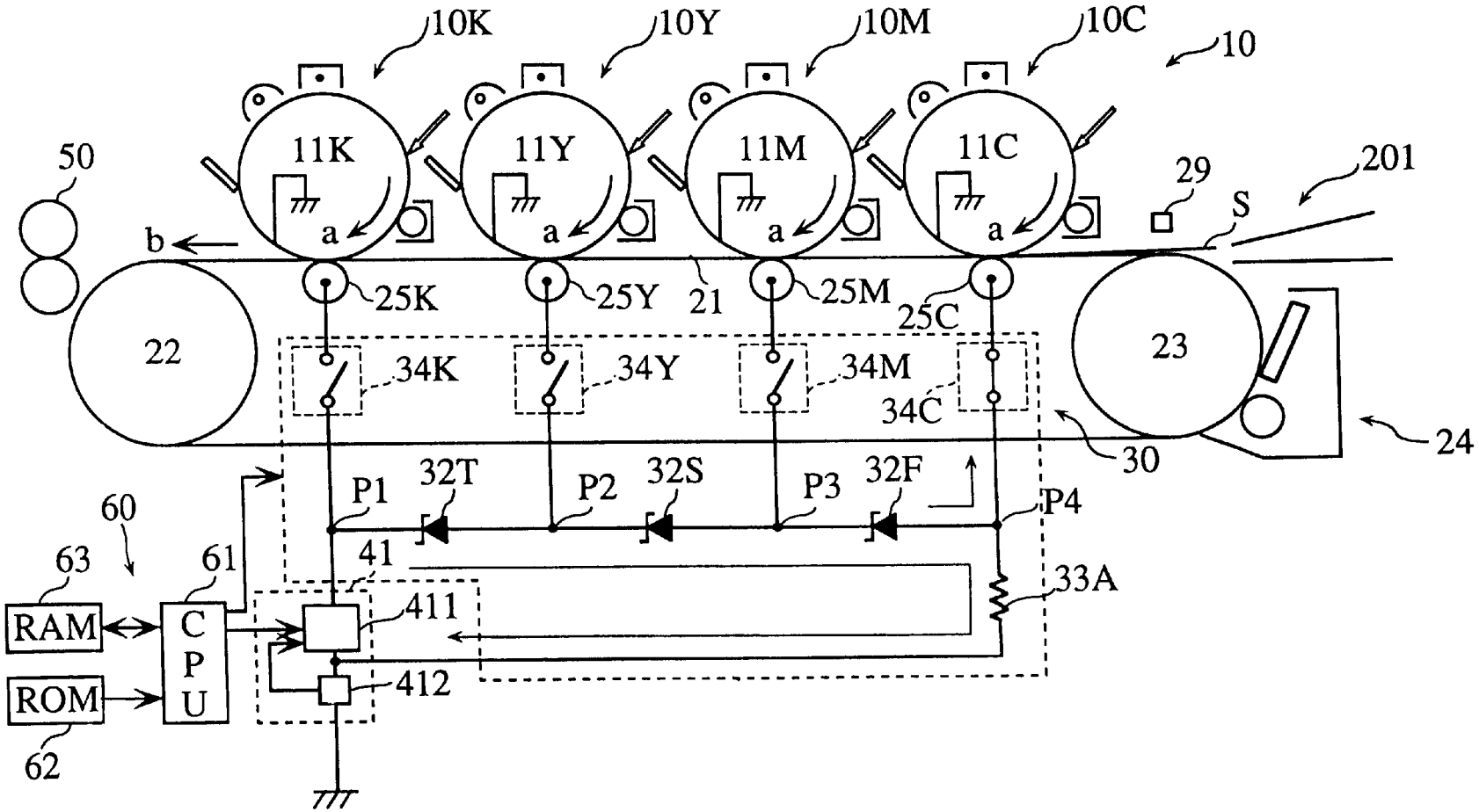
FIG. 11 shows an image forming section of a tandem-type copier in case that switch units are provided in FIG. 10.

FIG. 11 shows a construction in case that a plurality of switch units are provided in the image forming section in. FIG. 10. The image forming section in FIG. 11 is basically the same as in FIG. 10, except that a plurality of switch units 34C to 34K are provided in the paths between each point at which each divided voltage is obtained and each of the transfer rollers 25C to 25K.

Each of the switch units 34C to 34K is controlled by the CPU 61 so as to be turned ON only when the recording sheet S is passing through the corresponding transfer position. Since the manner of this ON/OFF control is the same as described in the above FIG. 9, the description thereof will be omitted.

This modification is different from FIG. 9 in the contents of the control by the constant current power supply 41.

That is to say, when the front end of the recording sheet S is transported to the transfer position of the transfer roller 25C, the switch unit 34C is turned ON according to the instruction from a main CPU, while the CPU 61 sets a current which becomes a standard value to be controlled by the constant current control unit 411 (hereafter called a standard current value) to the optimum transfer current I1. Then, the constant current control unit 411 controls a current so that the optimum current flows according to the detected value by the current detector 412. Next, when the front end of the recording sheet S is transported to the transfer position of the transfer roller 25M, the switch unit 34M is turned ON. At the same time, the CPU 61 sets the standard current value for the constant current control unit 411 to a current obtained by adding the optimum transfer current I2 to the current I1 (=I1+I2) and makes the constant current control unit 411 control by the constant current control method. Here, after the rear end of the recording sheet S has passed through the transfer position of the transfer roller 25C, the switch unit 34C is turned OFF and the standard current value for the constant current control unit 411 is changed to I2. As stated above, the current supplied from the constant current power supply 41 is controlled to be equal to a sum of optimum transfer current(s) which should be fed through the transfer roller(s) whose transfer position is occupied with the recording sheet S, in synchronization with the ON/OFF operation of each of the switch units.

By means of above stated construction, the deterioration of transfer rollers and photosensitive drums, resulting from unnecessary application of power during the period other than a transfer operation, because no voltage is applied to the transfer rollers during the period other than the transfer operation can be avoided. Therefore, the lives of the transfer rollers and photosensitive drums will be increased. Besides, a current passing from each transfer roller to the corresponding photosensitive drum can be controlled to a fixed value, so that a stable transfer efficiency can be secured, even if the resistance value of the transfer current path varies due to a change in the resistance value thereof over time or surrounding conditions, such as temperature and humidity.

Alternatively, another modification of the third embodiment may be configured so that a current is fed back to the constant current control unit 411 via the resistance circuit whose resistance value is equivalent to a resistance value of the transfer current path, as a substitute for the switch units 34C to 34K serving as completely disconnecting the transfer current paths.

Figure 12:
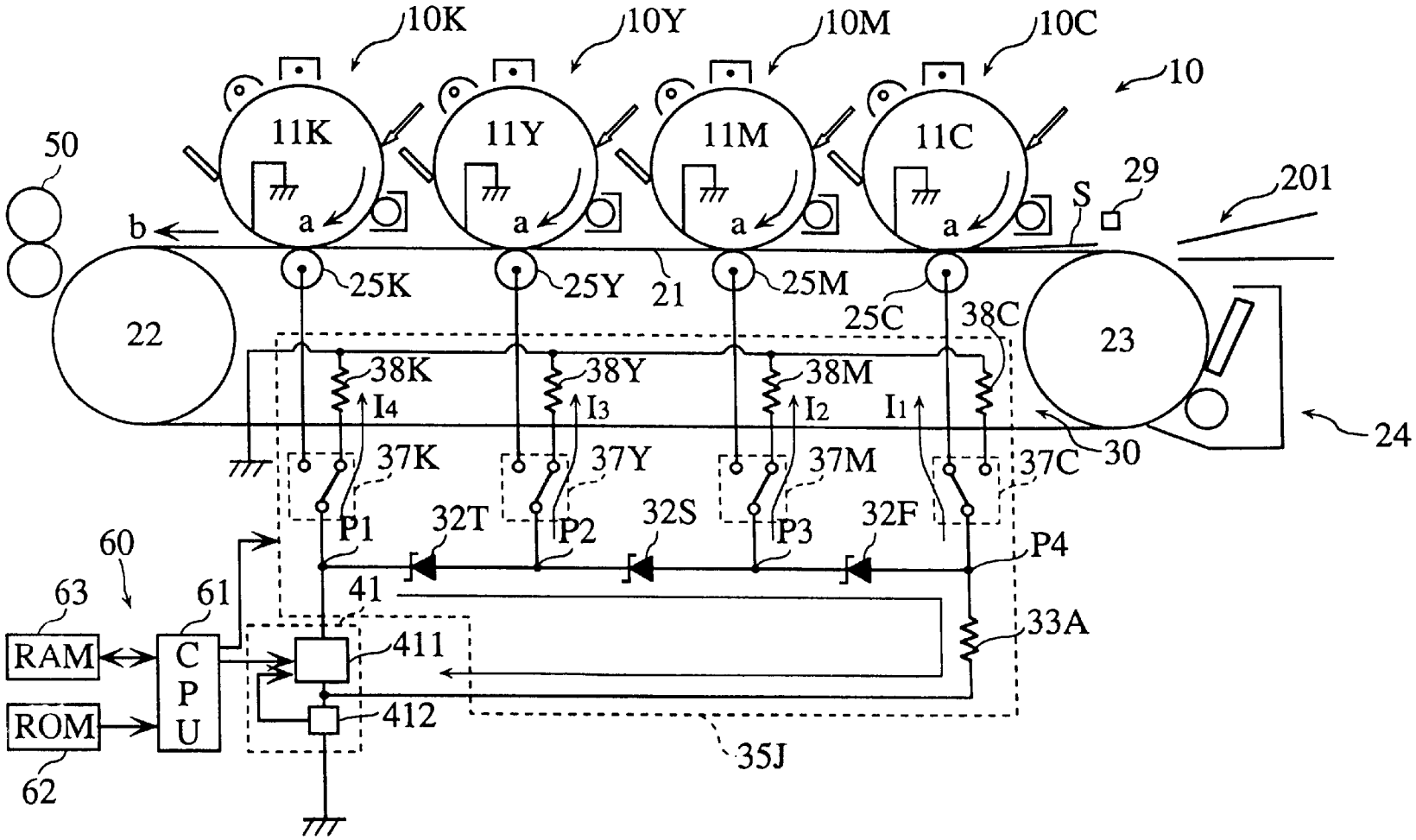
FIG. 12 shows an image forming section of a tandem-type copier in case that selector switches are provided in FIG. 10.

FIG. 12 shows a construction of a voltage distributing circuit 35J in this case.

Only when the recording sheet S is passing through the corresponding transfer position, each selector switch 37C to 37K is switched into each of the transfer roller (25C to 25K) side. At all other times, they are switched into the fixed resistors 38C to 38K sides, respectively. A sum of currents passing through each transfer current path and each of the fixed resistors 38C to 38K is detected by the current detector 412 via an earthed circuit.

A resistance value of each of the fixed resistors 38C to 38K is set to be equivalent to the resistance value of the transfer current path from each of the transfer rollers 25C to 25K to the earthed circuit via corresponding photosensitive drum among 11C to 11K. Therefore, there is no need to change the standard current value according to the connect/disconnect conditions of the switch units 34C to 34K as in the case of FIG. 11 and the constant current power supply 41 is controlled to be an optimum transfer current only (i.e., I1+I2+I3+I4) which are set in advance.

(2) In the third embodiment as stated above, the transfer rollers contacting with the transport belt 21 are used for electric field appliers, but non-contact corona dischargers may be used as the transfer members.

Figure 13:
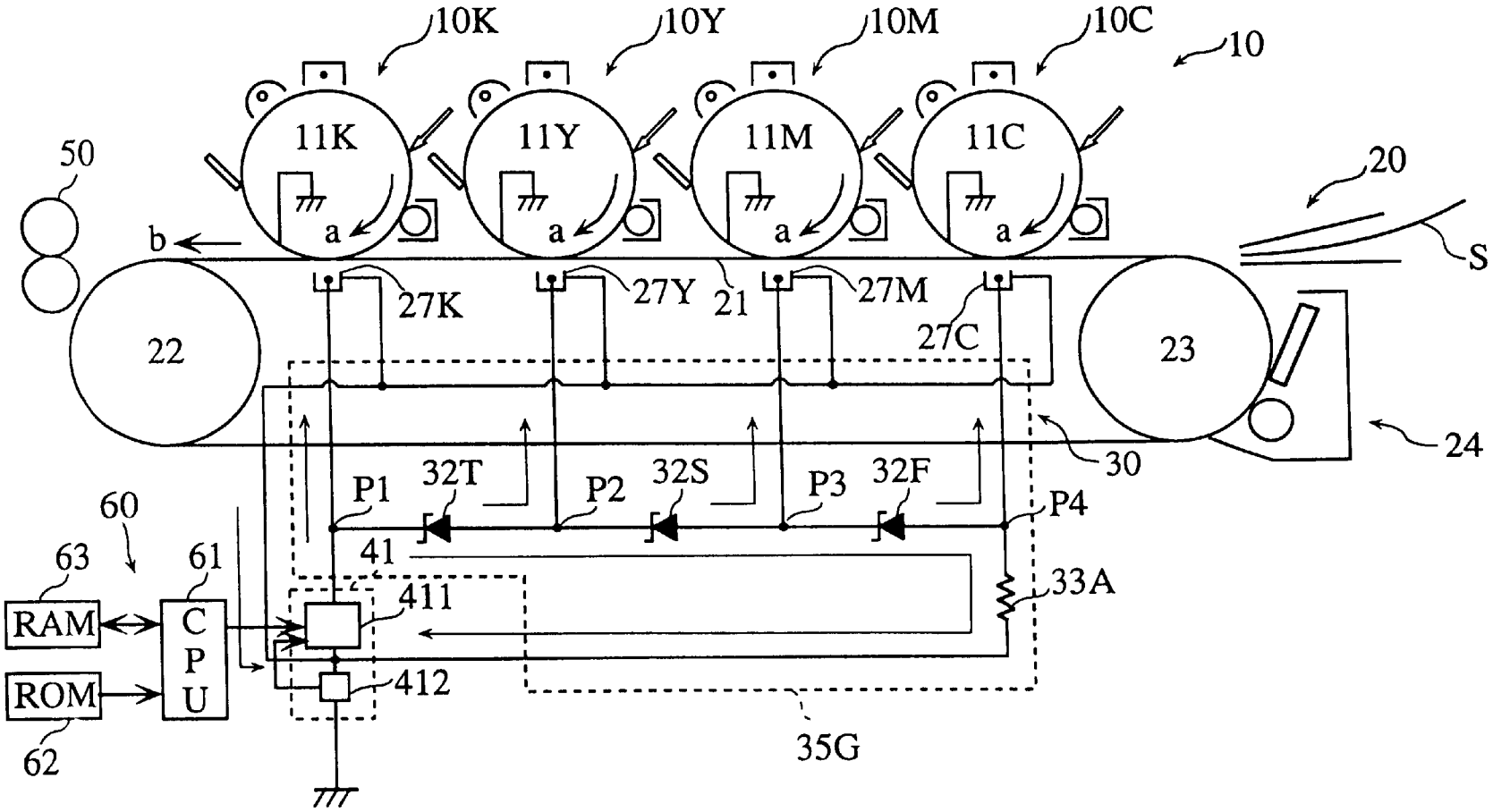
FIG. 13 shows an image forming section of a tandem-type copier wherein corona dischargers replace transfer rollers in FIG. 10.

FIG. 13 shows a construction, wherein corona dischargers 27C to 27K are substituted for transfer rollers as in FIG. 10. A shielding case of each of the corona dischargers 27C to 27K is not grounded but connected to a point between the constant current control unit 411 and the current detector 412. By means of above described construction, even if corona dischargers are used for transfer members, the same effects can be obtained as in FIG. 10.

(Fourth Embodiment)

Finally, the fourth embodiment of a tandem-type copier according to the present invention will be described.

Figure 14:
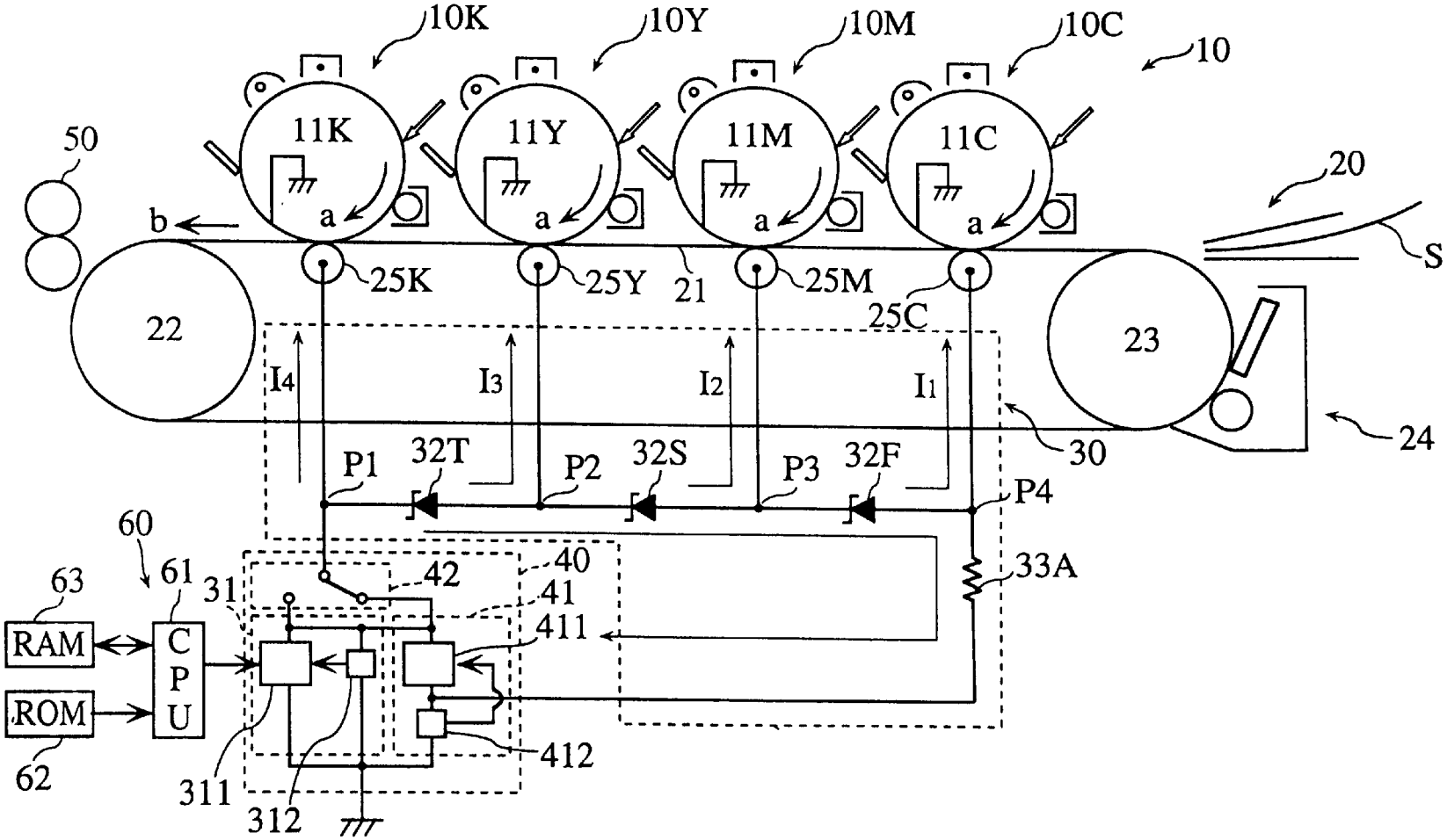
FIG. 14 shows an image forming section of a tandem-type copier according to the fourth embodiment of the present invention.

FIG. 14 shows an image forming section of a tandem-type copier according to the fourth embodiment of the present invention. An image forming section shown in FIG. 14 is the same as in FIG. 10, except that a construction of a constant voltage/current power supply 40 and so on are different. Therefore, elements other than the elements assigned the same numbers as in FIG. 10 will be mainly described.

The constant voltage/current power supply 40 consists of a constant voltage power supply 31, a constant current power supply 41, and a selector switch 42.

An electromagnetic relay is used for the selector switch 42, where a switching operation is conducted so that transfer rollers 25C to 25K are connected to either a constant voltage control unit 311 or a constant current control unit 411. Hereafter, the state where the constant voltage control unit 311 is activated by switching the selector switch 42 to the constant voltage control unit 311 side is called "the constant voltage power supply ON", while the state where the constant current control unit 411 is activated by switching the selector switch 42 to the constant current control unit 411 side is called "the constant current power supply ON". Here, the state of the constant current power supply ON is the same state as in FIG. 10 according to the third embodiment.

One end of the fixed resistor 33A connected in series to the zener diode 32F is not grounded, but connected to a point between the current detector 412 and the constant current control unit 411, and connected directly to the constant current control unit 411, not via the current detector 412.

Here, a ROM 62 stores such as a control program which controls the constant voltage/current power supply 40 so as to maintain the fixed optimum transfer voltage. The following describes how the CPU 61 determines an applied voltage by the constant voltage power supply 31 in the constant voltage/current power supply 40.

First, the CPU 61 conducts the following control operation in accordance with the program stored in the ROM 62. That is, the CPU 61 switches the selector switch 42 to the side of constant current control unit 411 according to the control program stored in the ROM 62, while making the transport belt 21 rotating and traveling. The reason why the transport belt 21 is made to be rotating and traveling is to reduce the effects of non-uniform resistance distribution of the transport belt in the measurement by the voltmeter 312, which will be described later.

Next, the constant current control unit 411 is activated so that a sum of transfer currents I1 to I4 passing through transfer rollers 25C to 25K respectively is controlled to be equivalent to the predetermined current.

The CPU 61 stores a measurement result outputted from the voltmeter 312 in the RAM 63. Hereafter, the measurement value of the voltmeter 312 in the state where the constant current power supply is turned ON is called a "standard constant voltage control value" for the transfer rollers. According to this standard constant voltage control value and the optimum transfer current, a total sum of resistance values of paths from the plurality of transfer rollers 25C to 25K, at four transfer positions, to the plurality of photosensitive rollers 11C to 11K respectively, by way of the transport belt 21 can be estimated. Here, this total resistance value includes the average resistance value of the transfer belt. This is because local variations of resistance of the transfer belt is leveled off, since the standard constant voltage value is measured in the state where the transport belt is rotating and traveling.

The ROM 62 stores a table showing a relation between a total resistance value and an applied voltage in advance, so that an optimum applied voltage is determined according to the estimated total resistance. Above described process is mainly performed on switch-on of the apparatus. However, this process may be performed immediately before an execution of each printing job or every predetermined number of printed sheets.

Then, the selector switch 42 is switched to the side of the constant voltage control unit 311 at the transfer operation, and the constant voltage power supply is turned ON to apply the determined optimum voltage as above. Thereby, the optimum transfer voltage is applied to each of the plurality of the transfer rollers 25C to 25K, according to the total resistance value of the transport belt and the transfer rollers. Thus, the optimum transfer voltage can be applied to the transfer rollers in response to such as the deterioration of the transfer rollers and the transport belt due to application of power and surrounding conditions including temperature and humidity. Therefore, the transfer efficiency is continuously stable and an excellent quality of images can be obtained. In addition, transfer rollers having the same resistance can be used in the same way as the first embodiment, so that a low-cost tandem-type copier can be realized.

Meanwhile, when the total resistance value is estimated, if a current is set in advance to a total sum of the predetermined optimum transfer currents by means of the constant current control unit 411, a voltage detected by the voltmeter 312 at this point can be adopted as an optimum voltage to be generated at the constant voltage control unit 311. In this case, although the total sum of the optimum transfer currents is different in each apparatus due to the difference in such as used materials, this value can be easily obtained through experiments or the like.

(Modifications in the Fourth Embodiment)

The following modifications may apply to the above fourth embodiment.

(1) In the above fourth embodiment, the constant current is fed to four transfer rollers by means of the constant current control unit 411 to measure the standard constant voltage control value. However, a standard constant voltage control value may be measured for a specific transfer roller individually.

Especially, in case of printing a monochrome image, only the image forming device 10K is used. Therefore, it is useful to constitute the apparatus so that the standard constant voltage control value can be obtained for the transfer roller 25K only.

Figure 15:
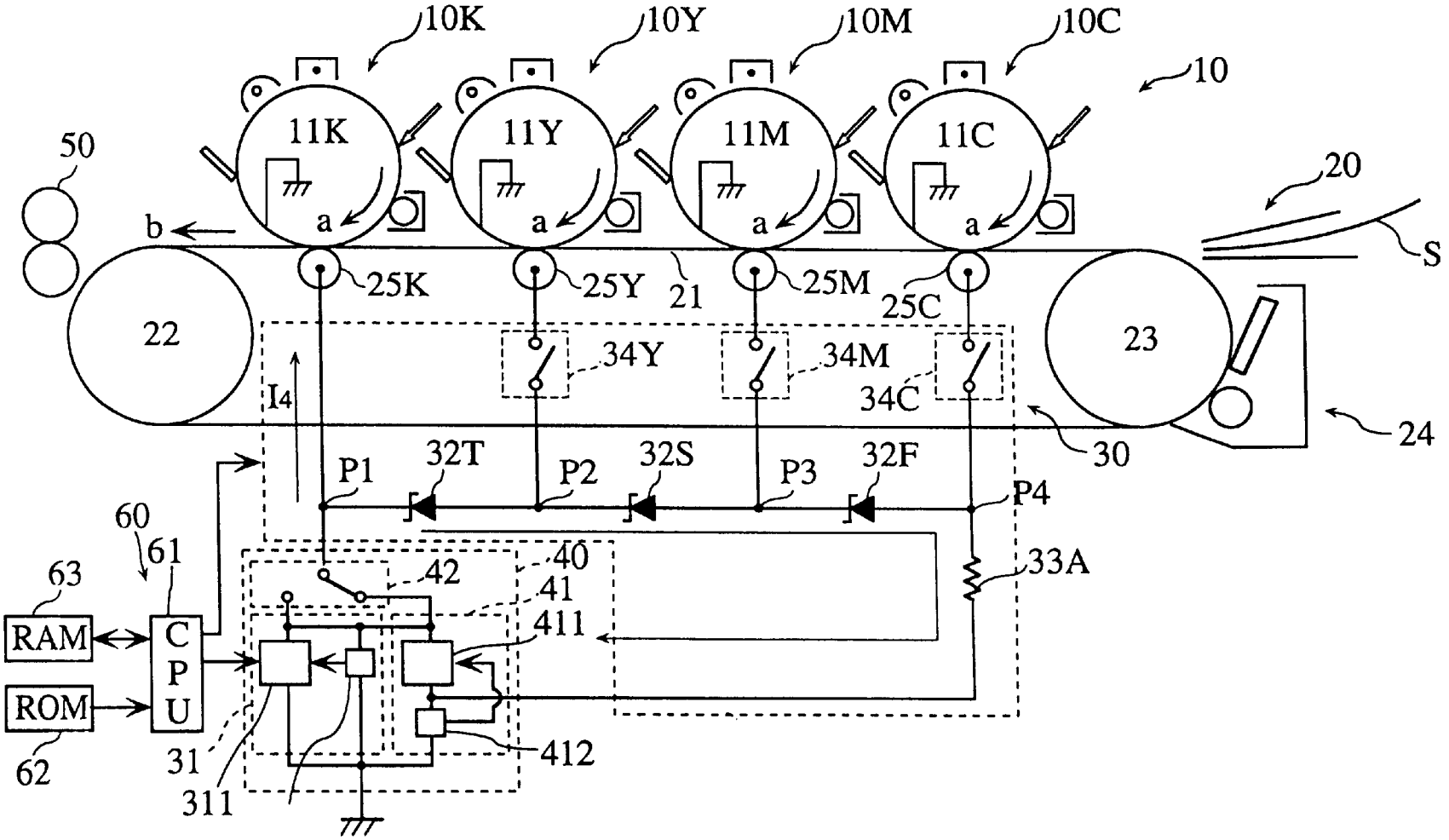
FIG. 15 shows an image forming section of a tandem-type copier in case that switch units are provided in FIG. 14.

FIG. 15 shows a construction as in this case, which is different from FIG. 14 in that switch units 34C to 34Y are provided in the transfer current path between the voltage distributing circuit and each of the plurality of the transfer rollers for color images 25C to 25Y.

In case that the standard constant voltage control value is obtained for the transfer roller 25K only, the switch units 34C to 34Y are switched to the OFF sides, and the constant current power supply 41 is turned ON to start a constant current control operation. Then, the voltmeter 312 detects a volt generated at the constant current control unit 411 and which voltage is set to a standard constant voltage control value, whereby a resistance of the transfer current path is calculated. Then, a control voltage is obtained in the constant voltage control state. In case of conducting a monochrome printing operation, the switch units 34C to 34K are switched to the OFF sides, and the control voltage power supply is controlled so that the control voltage obtained as above is generated at the constant voltage control unit 311 to apply the same to the transfer roller 25K, whereby a transfer efficiency at the monochrome printing operation can be stable.

Figure 16:
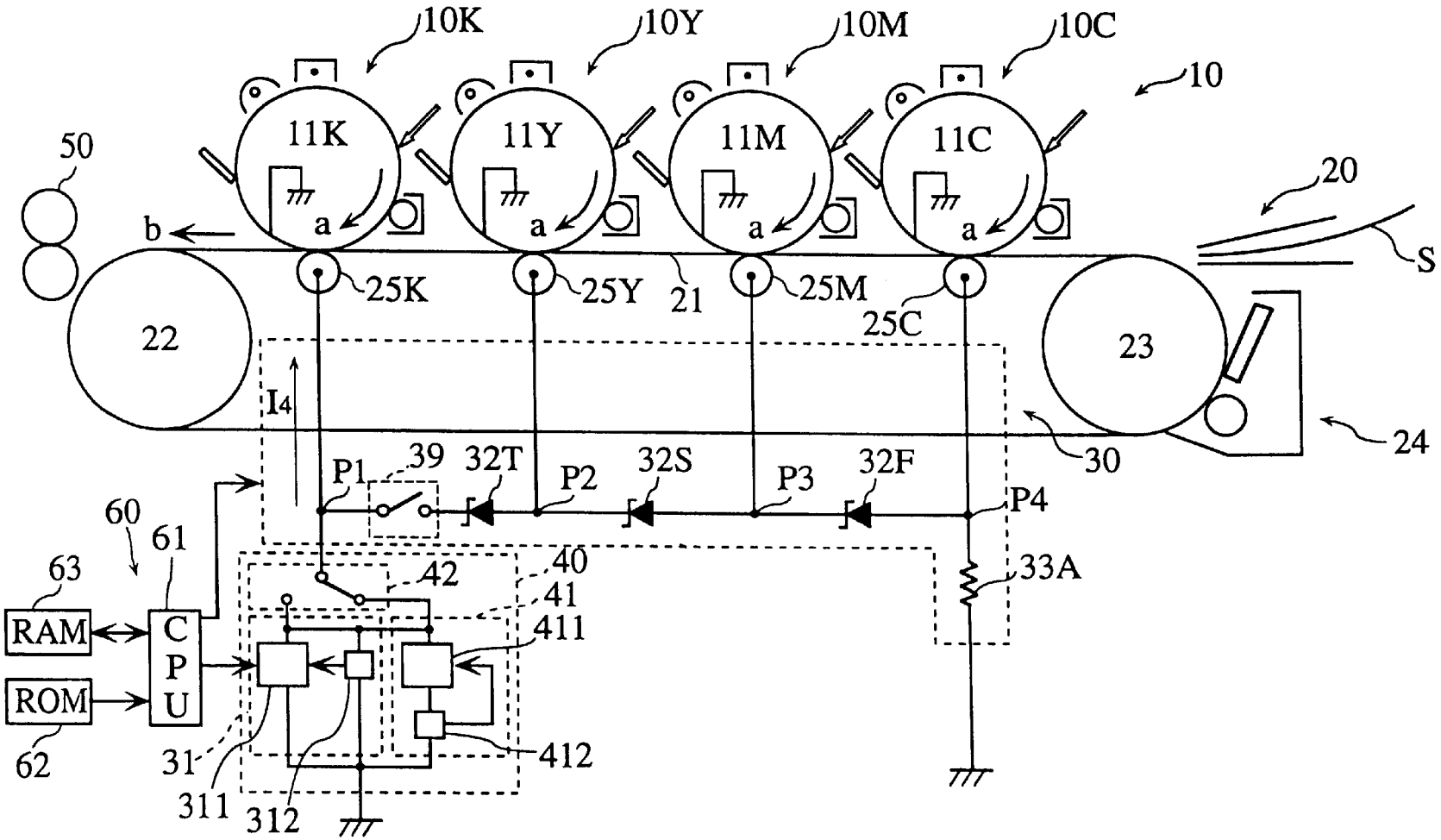
FIG. 16 shows an image forming section of a tandem-type copier in case that a switch unit is provided in FIG. 14.

In this modification, individual switch units 34C to 34K are provided in the transfer current paths through each of the plurality of transfer rollers for color images 25C, 25M, and 25Y. However, one switch unit 39 may be substituted for these switch units as in FIG. 16, whereby all of the transfer current path of the transfer rollers for color images are disconnected at the same time, because these switches are turned ON at the almost same time during color printing operation. Here, in FIG. 16, one end of the fixed resistor 33A is grounded, because if the- switch unit 39 is disconnected, no current is fed to the fixed resistor 33A, so that there is no harm in detecting a transfer current by the current detector 412. However, in case of obtaining a total standard constant voltage control value also, the switch unit 39 is turned ON. Therefore, it is preferable to connect it as in FIG. 15, where a current passing through the fixed resistor 33A does not pass through the current detector 412.

In addition, a construction where the photosensitive drums 11C to 11Y are detached from the transport belt 21 may be used in order to prevent the image forming devices 10C to 10Y for color images from wearing during monochrome printing operation. Thereby, above described switch units for disconnecting the transfer current path are omissible.

Figure 17:
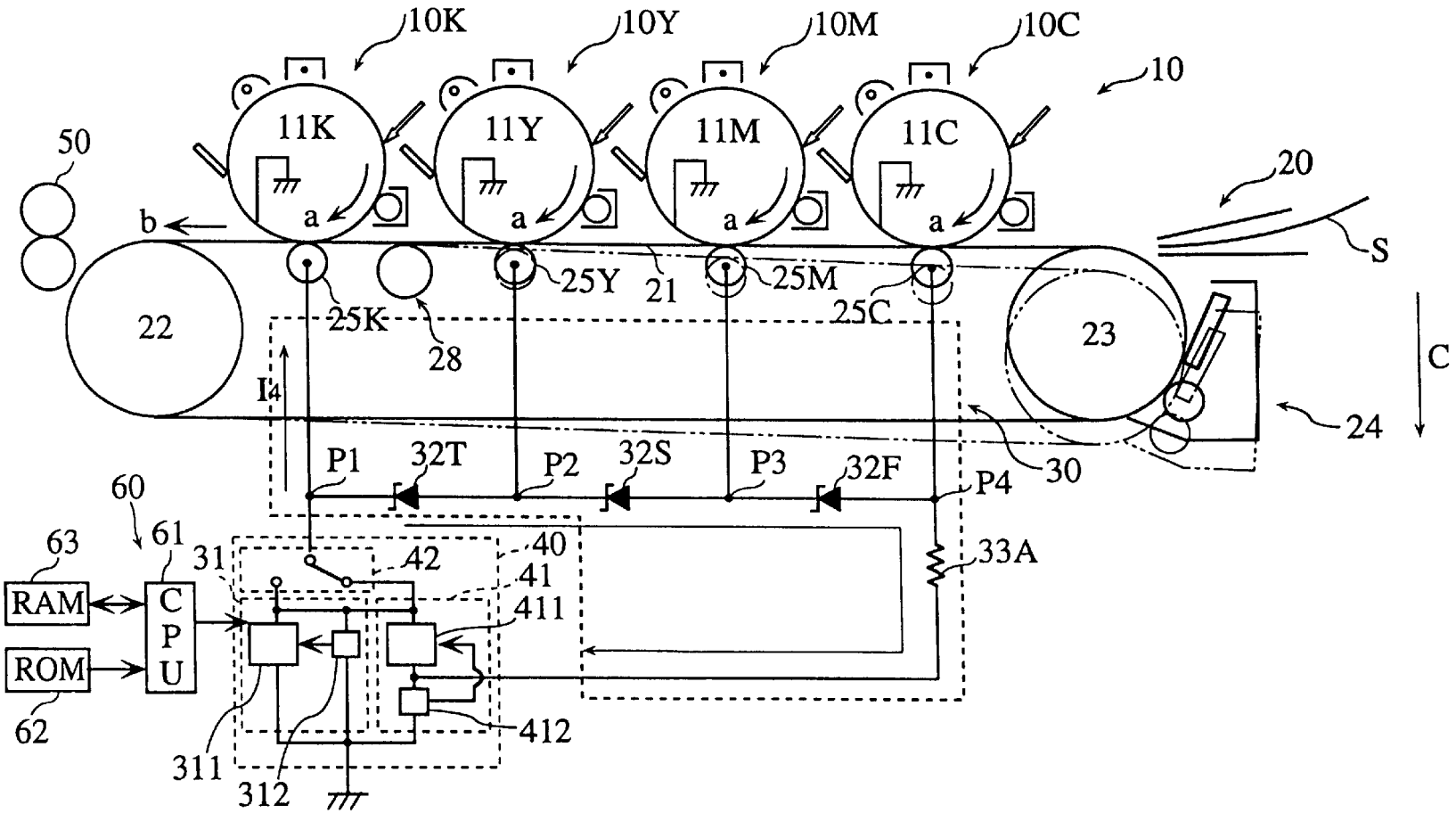
FIG. 17 shows an image forming section of a tandem-type copier in case a detachable mechanism of the transport belt are employed in FIG. 14.

FIG. 17 shows an example of an image forming section in this case.

The sheet transport unit 20 includes a backup roller 28 between the transfer positions of the transfer rollers 25Y and 25K and a frame member (not shown) supporting all of the transfer rollers 25C to 25Y, the slave roller 23, and the belt cleaner 24. This frame member can oscillate vertically on a driving axis of the driving roller 22 as a spindle. When an actuator (not shown) oscillates the frame member downward (in the direction of the arrow C) to be in a position indicated by two-dot chain lines, no current is fed to each of the plurality of photosensitive drums 11C to 11Y from each of the plurality of transfer rollers 25C to 25Y. Then, a resistance value of the transfer current path through the transfer roller 25K can be obtained in the same way as above described for FIGS. 15 and 16.

Since each transfer roller is made of the same material, the deterioration of each transfer roller due to application of power will be the same degree. Therefore, if a resistance value of a transfer current path through at least one transfer roller is obtained, those of the other transfer rollers can be regarded as the same. Thereby, a standard constant voltage control value in case that all of the transfer rollers function can be easily obtained according to the value.

Although electrophotographic tandem-type copiers are mainly described in the above embodiments, the present invention is not limited to those copiers. That is, the invention may apply to an apparatus where a photosensitive drum is shared between a plurality of image forming devices, i.e., a construction where a plurality of exposure units and developing units are provided around one photosensitive drum, and an apparatus having a plurality of so-called electrostatic record type image forming devices, where an electrostatic latent image is recorded on the surface of a photosensitive drum by applying a voltage to a plurality of needle electrodes arranged with a fixed pitch and in the main scanning direction. Thus, the present invention may apply to general image forming apparatuses forming images by transferring images formed using any image forming devices using a plurality of transfer devices.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus, comprising:

a plurality of image forming devices;

a plurality of transfer members which are provided in one-to-one correspondence with the image forming devices, and sequentially transfer images formed by the image forming devices onto a transfer medium;

a transfer power supply device which generates a predetermined voltage for a transfer operation; and a voltage distributing circuit which is arranged between the transfer power supply device and each of the transfer members, and distributes different voltages to one-to-one correspondence with the transfer members.

2. The image forming apparatus of claim 1, further comprising:

a transport belt which transports the transfer medium, wherein the transfer medium is a recording sheet, the image forming devices are provided along the transport belt, and each of the transfer members is arranged in a position opposite to the corresponding image forming device.

3. The image forming apparatus of claim 2, wherein the voltage distributing circuit distributes so that an applied voltage of the transfer member provided downstream in the transport direction of the recording sheet is higher than that of the transfer member provided upstream in the transport direction.

4. The image forming apparatus of claim 1, wherein the transfer medium is a transfer belt driven to rotate in a longitudinal direction of the belt, the image forming devices are arranged along the transfer belt, and each of the transfer members is arranged in a position opposite to the corresponding image forming device.

5. The image forming apparatus of claim 4, wherein the voltage distributing circuit distributes so that an applied voltage of the transfer member provided downstream in the rotating direction of the transfer belt is higher than that of the transfer member provided upstream in the rotating direction.

6. The image forming apparatus of claim 1, wherein the voltage distributing circuit includes a plurality of voltage drop elements connected in series with each other, a number of the voltage drop elements is one less than a number of the transfer members, wherein one of the transfer members is directly connected to the transfer power supply device, and each of the other transfer members is connected to the transfer power supply device, via a different number of one or more voltage drop elements.

7. The image forming apparatus of claim 6, wherein the plurality of voltage drop elements are resistors or constant voltage elements.

8. The image forming apparatus of claim 6, wherein the transfer power supply device includes:

a current supply device which supplies a predetermined current to the voltage distributing circuit;

a current detector;

a current controller which controls the current supply device so as to supply the predetermined current, according to a first current detected by the current detector;

wherein the voltage distributing circuit feeds back the first current passing through the plurality of image forming devices, among the predetermined current supplied from the current supply device, to the current supply device via the current detector, and feeds back a second current directly to the current supply unit.

9. The image forming apparatus of claim 8, wherein the voltage distributing circuit includes a plurality of switches for switching between connect/disconnect states for the transfer power supply device and each of the transfer members, and the plurality of switches are provided to correspond to the transfer members respectively, the image forming apparatus, further comprising: a switch controller which controls a switching operation of the switches so that an outputted voltage from the transfer power supply device is applied to one or more transfer members, carrying out transfer operations, and not applied to the remaining one or more transfer members not carrying out transfer operations.

10. The image forming apparatus of claim 9, wherein the current controller controls the current supply device, in accordance with the connect/disconnect state of each of the plurality of switches, so that the first current detected by the current detector becomes equivalent to a total sum of transfer currents to be fed to the transfer members to which the outputted voltage is applied.

11. The image forming apparatus of claim 8, wherein the voltage distributing circuit includes:

a plurality of main paths connected from each of the transfer members to a ground via each of the image forming devices;

a plurality of bypass paths connected from each of resistances to a ground and provided to correspond to each of the main paths; and a selector switch unit which has a plurality of switches switching one connection end of each path from the transfer power supply device into either a main path side or a bypass path side;

wherein the selector switch unit, when an image is formed, controls each of the plurality of switches, so that voltages are applied to one or more transfer members performing transfer operations by switching the connection ends to the corresponding one of the main paths, and no voltage is applied to the remaining one or more transfer members not performing transfer operations by switching the connection ends to the corresponding one of the bypass paths.

12. The image forming apparatus of claim 1, wherein the voltage distributing circuit includes a plurality of switches for switching between connect/disconnect states for the transfer power supply device and each of the transfer members, and the plurality of switches are provided to correspond to the transfer members respectively, the image forming apparatus, further comprising:

a switch controller which controls a switching operation of the switches so that an outputted voltage from the transfer power supply device is applied to one or more transfer members, carrying out transfer operations, and not applied to the remaining one or more transfer members not carrying out transfer operations.

13. The image forming apparatus of claim 1, further comprising:

a resistance value detector which detects a resistance value of each of a plurality of transfer current paths from the transfer power supply device to a ground via each of the transfer members and a part of each of the image forming devices, prior to a transfer operation; and a voltage controller which controls the transfer power supply device so that the predetermined voltage is changed according to a measurement result of the resistance value detector.

14. The image forming apparatus of claim 13, wherein the resistance value detector includes:

a constant current element which feeds a constant current to the voltage distributing circuit; and a voltage detector which detects a voltage generated at the constant current element during feeding the current;

wherein the resistance value detector gives the resistance value of each of the transfer current paths in accordance with a measurement result of the voltage detector and the constant current.

15. The image forming apparatus of claim 14, further comprising:

a path disconnecting device which electrically disconnects the other transfer current paths, when a resistance value of one of the transfer current paths is evaluated.

16. The image forming apparatus of claim 15, wherein each of the plurality of image forming devices has an image holding element and each of the transfer members is provided so as to electrically contact with the image holding element of the corresponding image forming device, wherein the path disconnecting device, when a resistance value of one of the transfer current paths is evaluated, relatively detaches the image holding elements from the transfer members in the other transfer current paths.

17. An image forming apparatus, comprising:

at least three image forming devices;

a plurality of transfer members which are provided in one-to-one correspondence with the image forming devices, and sequentially transfer images formed by the image forming devices onto a transfer medium;

a plurality of transfer power supply devices which generates predetermined voltages for transfer operations, a number of the transfer power supply devices is one less than a number of the transfer members; and a voltage distributing circuit which is arranged between two or more transfer members and a first transfer power supply device among the transfer power supply devices and distributes different voltages to one-to-one correspondence with two or more transfer members.

18. The image forming apparatus of claim 17, further comprising:

a transport belt which transports the transfer medium, wherein the transfer medium is a recording sheet, the image forming devices are provided along the transport belt, and each of the transfer members is arranged in a position opposite to the corresponding image forming device.

19. The image forming apparatus of claim 18, wherein the plurality of transfer power supply devices consist of the first transfer power supply device and a second transfer power supply device to apply a voltage to a first transfer member among the plurality of transfer members, and the first transfer power supply device applies a voltage to remaining transfer members other than the first transfer member.

20. The image forming apparatus of claim 19, wherein the voltage distributing circuit distributes so that an applied voltage of the transfer member provided downstream in the transport direction of the recording sheet is higher than that of the transfer member provided upstream in the transport direction.

21. The image forming apparatus of claim 20, wherein the first transfer member is arranged furthest downstream in the transport direction and is applied the largest voltage among the plurality of the transfer members.

22. The image forming apparatus of claim 17, wherein the transfer medium is a transfer belt driven to rotate in a longitudinal direction of the belt, the image forming devices are arranged along the transfer belt, and each of the transfer members is arranged in a position opposite to the corresponding image forming device.

23. The image forming apparatus of claim 22, wherein the plurality of transfer power supply devices consist of the first transfer power supply device and a second transfer power supply device to apply a voltage to a first transfer member among the plurality of transfer members, and the first transfer power supply device apply a voltage to remaining transfer members other than the first transfer member.

24. The image forming apparatus of claim 23, wherein the voltage distributing circuit distributes so that an applied voltage of the transfer member provided downstream in the rotating direction of the transfer belt is higher than that of the transfer member provided upstream in the rotating direction.

25. The image forming apparatus of claim 24, wherein the first transfer member is arranged furthest downstream in the rotating direction of the transfer belt, and is applied the largest voltage among the plurality of the transfer members.

26. The image forming apparatus of claim 17, the voltage distributing circuit includes plurality of voltage drop elements connected in series with each other, a number of the voltage drop elements is one less than a number of the transfer members connected to the first transfer power supply device, wherein one of the transfer members is directly connected to the first transfer power supply device, and each of the other transfer members is connected to one of the plurality of transfer power supply devices, via a different number of one or more voltage drop elements.

27. The image forming apparatus of claim 26, wherein the plurality of voltage drop elements are resistors or constant voltage elements.

28. An image forming apparatus, comprising:

a first image forming device including a first image holding element for holding a first toner image;

a second image forming device including a second image holding element for holding a second toner image;

a first transfer member for transferring the first toner image held on the first image holding element to a transfer medium;

a second transfer member for transferring the second toner image held on the second image holding element to the transfer medium;

a transfer power supply device for supplying a predetermined voltage for a transfer operation; and a voltage distributing circuit arranged between the transfer power supply device and the first and second transfer members, the voltage distributing circuit distributing a first voltage to the first transfer member and a second voltage to the second transfer member, the second voltage being higher than the first voltage.

29. The image forming apparatus of claim 28, further comprising:

a transport belt for transporting the transfer medium, wherein the transfer medium is a recording sheet, the first transfer member is arranged upstream in a transport direction of the recording sheet than the second transfer member.

30. The image forming apparatus of claim 28, wherein the transfer medium is a transfer belt driven to rotate in a longitudinal direction of the transfer belt, the first transfer member is arranged upstream in a rotating direction of the transfer belt than the second transfer member.

* * * * *